US010634039B2

(12) United States Patent
Sugihara et al.

(10) Patent No.: US 10,634,039 B2
(45) Date of Patent: Apr. 28, 2020

(54) COOLING APPARATUS OF INTERNAL COMBUSTION ENGINE

(71) Applicant: TOYOTA JIDOSHA KABUSHIKI KAISHA, Toyota-shi, Aichi-ken (JP)

(72) Inventors: Hiroyuki Sugihara, Sunto-gun (JP); Yuji Miyoshi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 26 days.

(21) Appl. No.: 15/937,534

(22) Filed: Mar. 27, 2018

(65) Prior Publication Data

US 2018/0298807 A1 Oct. 18, 2018

(30) Foreign Application Priority Data

Apr. 13, 2017 (JP) ..... 2017-079368

(51) Int. Cl.

| | |
|---|---|
| ***F01P 7/16*** | (2006.01) |
| ***F01P 3/02*** | (2006.01) |
| ***F01P 5/10*** | (2006.01) |
| ***F02F 1/14*** | (2006.01) |
| ***F02F 7/00*** | (2006.01) |
| ***F02F 1/40*** | (2006.01) |
| ***F01P 7/14*** | (2006.01) |

(52) U.S. Cl.

CPC ..... *F01P 7/165* (2013.01); *F01P 3/02* (2013.01); *F01P 5/10* (2013.01); *F01P 7/16* (2013.01); *F02F 1/14* (2013.01); *F02F 1/40* (2013.01); *F02F 7/007* (2013.01); *F01P 2003/028* (2013.01); *F01P 2007/146* (2013.01); *F01P 2025/31* (2013.01); *F01P 2025/33* (2013.01); *F01P 2037/02* (2013.01)

(58) Field of Classification Search

CPC ..... F01P 7/165; F01P 7/16; F01P 5/10; F01P 3/02; F01P 2037/02; F01P 2003/028; F01P 2007/146; F01P 2025/31; F01P 2025/33; F02F 1/40; F02F 7/007; F02F 1/14

See application file for complete search history.

(56) References Cited

U.S. PATENT DOCUMENTS

| | | | | |
|---|---|---|---|---|
| 4,759,316 A * | 7/1988 | Itakura | ..... | F01P 7/165 123/41.08 |
| 7,114,469 B1 * | 10/2006 | Taylor | ..... | B63H 21/00 123/41.08 |
| 2006/0162676 A1 * | 7/2006 | Pegg | ..... | F01P 7/164 123/41.1 |

FOREIGN PATENT DOCUMENTS

| | | |
|---|---|---|
| GB | 2540401 A | 1/2017 |
| JP | 2012-184693 | 9/2012 |
| JP | 2013-160183 A | 8/2013 |

OTHER PUBLICATIONS

U.S. Appl. No. 15/895,239, filed Feb. 13, 2018.

* cited by examiner

*Primary Examiner* — Jacob M Amick

*Assistant Examiner* — Charles Brauch

(74) *Attorney, Agent, or Firm* — Finnegan, Henderson, Farabow, Garrett & Dunner, LLP

(57) ABSTRACT

The cooling apparatus of the internal combustion engine according to the invention executes an incompletely-warmed state control for supplying the cooling water to the cylinder block water passage from the cylinder head water passage without flowing the cooling water through the radiator and supplying the cooling water to the cylinder head water passage from the cylinder block water passage when the temperature of the cooling water is lower than the engine completely-warmed water temperature at which the engine is estimated to be warmed completely.

3 Claims, 20 Drawing Sheets

| WARMED STATE | THERMAL DEVICE WATER SUPPLY IS NOT REQUESTED | THERMAL DEVICE WATER SUPPLY IS REQUESTED |
|---|---|---|
| COOL STATE | ACTIVATION CONTROL A | ACTIVATION CONTROL B |
| SEMI-WARMED STATE | ACTIVATION CONTROL C | ACTIVATION CONTROL D |
| COMPLETELY-WARMED STATE | ACTIVATION CONTROL E | ACTIVATION CONTROL F |

FIG.4

COOLING APPARATUS OF INTERNAL COMBUSTION ENGINE

BACKGROUND

Field

The invention relates to a cooling apparatus of an internal combustion engine for cooling the internal combustion engine by cooling water.

Description of the Related Art

Amount of heat which a cylinder block of an internal combustion engine receives from cylinders thereof, is smaller than the amount of the heat which a cylinder head of the engine receives from the cylinders. Therefore, a temperature of the cylinder block increases slowly, compared with a temperature of the cylinder head.

There is known a cooling apparatus of the engine configured to supply cooling water to the cylinder head without supplying the cooling water to the cylinder block when a temperature of the cooling water is lower than a temperature at which the engine is estimated to be warmed completely (see JP 2012-184693 A). Hereinafter, the temperature at which the engine is estimated to be warmed completely, will be referred to as "the engine completely-warmed water temperature."

According to the known cooling apparatus, the temperature of the cylinder block increases promptly. As a result, the warming of the engine is completed promptly.

The known cooling apparatus is configured to supply the cooling water to the cylinder block when the temperature of the cooling water becomes equal to or higher than the engine completely-warmed water temperature. Therefore, the known cooling apparatus determines that the cylinder block is warmed completely when the temperature of the cooling water becomes equal to or higher than the engine completely-warmed water temperature. In this regard, the known cooling apparatus stops supplying the cooling water to the cylinder block while the temperature of the cooling water is lower than the engine completely-warmed water temperature. Therefore, the temperature of the cooling water may represent the temperature of the cylinder block.

Thus, even when the temperature of the cooling water becomes equal to or higher than the engine completely-warmed water temperature while a supply of the cooling water to the cylinder block is stopped, the cylinder block may not be warmed completely. In this case, friction resistance of movable parts provided in the cylinder block is large. As a result, fuel consumption increases.

On the other hand, when the temperature of the cooling water is lower than the engine completely-warmed water temperature while the supply of the cooling water to the cylinder block is stopped, the cylinder block may be warmed completely. In this case, the temperature of the cylinder block increases excessively. As a result, the cooling water may boil in the cylinder block.

As described above, if determining a warmed state of the cylinder block on the basis of the temperature of the cooling water while the supply of the cooling water to the cylinder block is stopped, the cooling water may be supplied to the cylinder block even when the cylinder block is not warmed completely or the cooling water may not be supplied to the cylinder block even when the cylinder block is warmed completely.

SUMMARY

The invention has been made for solving the above-described problem. An object of the invention is to provide a cooling apparatus of the internal combustion engine capable of determining the warmed state of the cylinder block accurately while the cylinder block is being warmed.

A cooling apparatus of an internal combustion engine according to the invention comprises a head water passage (51), a block water passage (52), a radiator (71), and an electronic control unit (90).

The head water passage (51) is provided in a cylinder head (14) of the internal combustion engine (10). Cooling water for cooling the cylinder head (14) flows through the head water passage (51). The block water passage (52) is provided in a cylinder block (15) of the internal combustion engine (10). The cooling water for cooling the cylinder block (15) flows through the block water passage (52). The radiator (71) cools the cooling water. The electronic control unit (90) controls a flow of the cooling water supplied to the head and block water passages (14 and 15).

The electronic control unit (90) is configured to execute an incompletely-warmed state control for supplying the cooling water to the block water passage (52) from the head water passage (51) without flowing the cooling water through the radiator (71) and supplying the cooling water to the head water passage (51) from the block water passage (52) (see processes of steps 1220 and 1230 of FIG. 12, and steps 1320 and 1330 of FIG. 13) when a temperature of the cooling water is lower than an engine completely-warmed water temperature at which the engine (10) is estimated to be warmed completely (see determinations "Yes" at steps 1110 and 1120 of FIG. 11, and steps 1510 and 1520 of FIG. 15).

The electronic control unit (90) is configured to execute a completely-warmed state control for supplying the cooling water to the head and block water passages (51 and 52) from the head and block water passages (51 and 52) through the radiator (71) (see processes of steps 1420 and 1430 of FIG. 14) when the temperature of the cooling water is equal to or higher than the engine completely-warmed water temperature (see determinations "No" at the steps 1110 and 1120 of FIG. 11, and the steps 1510 and 1520 of FIG. 15).

The cooling apparatus according to the invention supplies the cooling water directly to the block water passage from the head water passage without flowing the cooling water through the radiator when the temperature of the cooling water is lower than the engine completely-warmed water temperature. In this regard, the cooling water supplied to the block water passage, has a temperature increased while the cooling water flows through the head water passage. Thus, a temperature of the cylinder block increases at the large rate, compared with when the cooling water is supplied to the block water passage through the radiator.

While the temperature of the cooling water is lower than the engine completely-warmed water temperature, the cooling water flows through the head and block water passages. Therefore, the temperature of the cooling water represents the temperature of the cylinder head as well as the temperature of the cylinder block. Thus, while the temperature of the cooling water is lower than the engine completely-warmed water temperature, the warmed state of the cylinder block is determined accurately, compared with when no cooling water is supplied to the block water passage. As a result, the cylinder block is likely to be warmed completely when a cooling water circulation control for circulating the cooling water changes from the incompletely-warmed state control to the completely-warmed state control. In addition, the temperature of the cooling water is prevented from increasing excessively in the block water passage before the cooling water circulation control changes from the incompletely-warmed state control to the completely-warmed state control. As a result, the cooling water is prevented from boiling in the block water passage.

The electronic control unit (90) may be configured to execute a cool state control as the incompletely-warmed state control for supplying a first amount of the cooling water to the block water passage (52) from the head water passage (51) without flowing the cooling water through the radiator (71), supplying the remaining amount of the cooling water to the block water passage (52) from the head water passage (51) through the radiator (71), and supplying the cooling water to the head water passage (51) from the block water passage (52) (see processes of steps 1210 and 1230 of FIG. 12) when the temperature of the cooling water is lower than a semi-warmed water temperature lower than the engine completely-warmed water temperature (see determinations "Yes" at a step 1110 of FIG. 11 and a step 1510 of the FIG. 15).

In this case, the electronic control unit (90) may be configured to execute a semi-warmed state control as the incompletely-warmed state control for supplying a second amount of the cooling water to the head water passage (51) from the head water passage (51) through the radiator (71), supplying the remaining amount of the cooling water to the block water passage (52) from the head water passage (51) without flowing the cooling water through the radiator (71), and supplying the cooling water to the head water passage (51) from the block water passage (52) (see processes of steps 1320 and 1330 of FIG. 13) when the temperature of the cooling water is equal to or higher than the semi-warmed water temperature (see determinations "Yes" at a step 1120 of FIG. 11 and a step 1520 of FIG. 15). In this case, the second amount is larger than the first amount.

When the temperature of the cooling water is equal to or higher than the semi-warmed water temperature and lower than the engine completely-warmed water temperature, the temperature of the cylinder head is high compared with when the temperature of the cooling water is lower than the semi-warmed water temperature. When a large part of the cooling water is supplied directly to the block water passage from the head water passage without flowing through the radiator, and the cooling water is supplied to the head water passage from the block water passage, the temperature of the cooling water increases excessively in a part of the head water passage. As a result, the cooling water may boil in the head water passage.

According to the invention, the flow rate of the cooling water supplied to the head water passage through the radiator at the temperature of the cooling water equal to or higher than the semi-warmed water temperature and lower than the engine completely-warmed water temperature, is larger than the flow rate of the cooling water supplied to the head water passage through the radiator at the temperature of the cooling water lower than the semi-warmed water temperature. Thus, the cooling water is prevented from boiling in the head water passage.

The electronic control unit (90) may be configured to execute the semi-warmed state control to control a flow rate of the cooling water in the block water passage (52) such that the flow rate of the cooling water in the block water passage (52) is small (see processes of steps 1320 and 1330 of FIG. 13) when a difference in the temperature of the cooling water between after and before the cooling water flows through the block water passage (52), is small, compared with when the difference in the temperature of the cooling water is large.

As described above, the temperature of the cylinder block increases slowly, compared with the temperature of the cylinder head. Therefore, the temperature of the cylinder block may be considerably lower than the temperature of the cylinder head when a water temperature difference, which is a difference of the temperature of the cooling water flowing out from the block water passage relative to the temperature of the cooling water flowing out from the head water passage, is large. In this case, when the cooling water circulation control changes from the incompletely-warmed state control to the completely-warmed state control after the temperature of the cooling water reaches the engine completely-warmed water temperature, the cylinder block may not be warmed completely. According to the invention, the flow rate of the cooling water flowing through the block water passage when the water temperature difference is large, is smaller than the flow rate of the cooling water flowing through the block water passage when the water temperature difference is small while the semi-warmed state control is executed. Therefore, the temperature of the cylinder block increases promptly. Thus, the cylinder block is likely to be warmed completely when the water temperature reaches the engine completely-warmed water temperature.

The cooling apparatus according to the invention may comprise a pump (70) and a switching valve (78) configured to be selectively set to any of a normal flow position for supplying the cooling water to the block water passage (52) from the pump (70) and an opposite flow position for supplying the cooling water to the pump (70) from the block water passage. In this case, the electronic control unit (90) may be configured to set the switching valve (78) to the opposite flow position when the incompletely-warmed state control is executed. Further, the electronic control unit (90) may be configured to set the switching valve (78) to the normal flow position when the completely-warmed state control is executed.

In the above description, for facilitating understanding of the present invention, elements of the present invention corresponding to elements of an embodiment described later are denoted by reference symbols used in the description of the embodiment accompanied with parentheses. However, the elements of the present invention are not limited to the elements of the embodiment defined by the reference symbols. The other objects, features, and accompanied advantages of the present invention can be easily understood from the description of the embodiment of the present invention along with the drawings.

BRIEF DESCRIPTION OF THE DRAWINGS

FIG. 4 is a view for showing activation controls executed by the cooling apparatus according to the embodiment.

DESCRIPTION OF THE PREFERRED EMBODIMENTS

Below, a cooling apparatus of an internal combustion engine according to an embodiment of the invention will be described with reference to the drawings. The cooling apparatus according to the embodiment is applied to an internal combustion engine 10 shown in FIG. 1 and FIG. 2. Hereinafter, the cooling apparatus according to the embodiment will be referred to as "the embodiment apparatus." The engine 10 is a multi-cylinder (in this embodiment, linear-four-cylinder) four-cycle piston-reciprocation type diesel engine. The engine 10 may be a gasoline engine.

Figure 1:
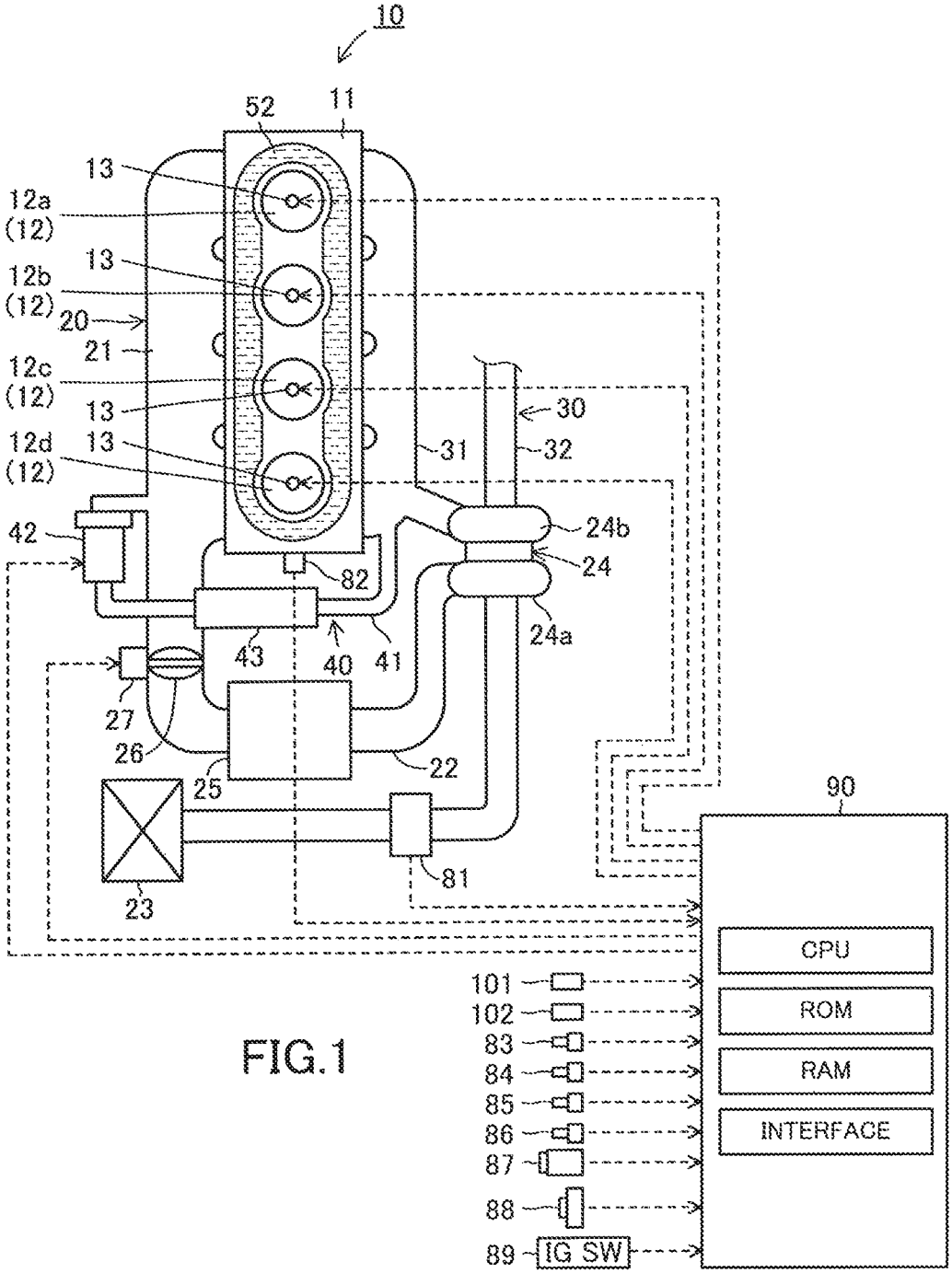
FIG. 1 is a view for showing an internal combustion engine to which a cooling apparatus according to an embodiment of the invention is applied.

As shown in FIG. 1, the engine 10 includes an engine body 11, an intake system 20, an exhaust system 30, and an EGR system 40.

The engine body 11 includes a cylinder head 14, a cylinder block 15 (see FIG. 2), a crank case (not shown) and the like. Four cylinders or combustion chambers 12*a* to 12*d* are formed in the engine body 11. Fuel injectors 13 are provided such that the fuel injectors 13 expose to upper areas of the cylinders 12*a* to 12*d*, respectively. Hereinafter, the cylinders 12*a* to 12*d* will be collectively referred to as "the cylinders 12." The fuel injectors 13 open in response to commands output from an electronic control unit 90 described later, thereby injecting fuel directly into the cylinders 12, respectively. Hereinafter, the electronic control unit 90 will be referred to as "the ECU 90."

The intake system 20 includes an intake manifold 21, an intake pipe 22, an air cleaner 23, a compressor 24*a* of a turbocharger 24, an intercooler 25, a throttle valve 26, and a throttle valve actuator 27.

The intake manifold 21 includes branch portions and a collecting portion. The branch portions are connected to the cylinders 12, respectively and to a collecting portion. The intake pipe 22 is connected to the collecting portion of the intake manifold 21. The intake manifold 21 and the intake pipe 22 define an intake passage. The air cleaner 23, the compressor 24*a*, the intercooler 25, and the throttle valve 26 are provided at the intake pipe 22 in order from upstream to downstream in a flow direction of the intake air. The throttle valve actuator 27 changes an opening degree of the throttle valve 26 in response to the commands output from the ECU 90.

The exhaust system 30 includes an exhaust manifold 31, an exhaust pipe 32, and a turbine 24*b* of the turbocharger 24.

The exhaust manifold 31 includes branch portions and a collecting portion. The branch portions are connected to the cylinders 12, respectively and to a collecting portion. The exhaust pipe 32 is connected to the collecting portion of the exhaust manifold 31. The exhaust manifold 31 and the exhaust pipe 32 define an exhaust passage. The turbine 24*b* is provided in the exhaust pipe 32.

The EGR system 40 includes an exhaust gas recirculation pipe 41, an EGR control valve 42, and an EGR cooler 43.

The exhaust gas recirculation pipe 41 communicates with the exhaust passage upstream of the turbine 24*b*, in particular, the exhaust manifold 31 and the intake passage downstream of the throttle valve 26, in particular, the intake manifold 21. The exhaust gas recirculation pipe 41 defines an EGR gas passage.

The EGR control valve 42 is provided in the exhaust gas recirculation pipe 41. The EGR control valve 42 changes a passage cross-section area of the EGR gas passage in response to the commands output from the ECU 90, thereby, changing an amount of an exhaust gas (i.e., EGR gas) recirculated from the exhaust passage to the intake passage. The exhaust gas is a gas discharged from the engine 10 to the exhaust passage.

The EGR cooler 43 is provided in the exhaust gas recirculation pipe 41 and lowers a temperature of the EGR gas passing through the exhaust gas recirculation pipe 41 by cooling water as described later. Therefore, the EGR cooler 43 is a heat exchanger for exchanging heat between the cooling water and the EGR gas, in particular, the heat exchanger for applying the heat from the EGR gas to the cooling water.

Figure 2:
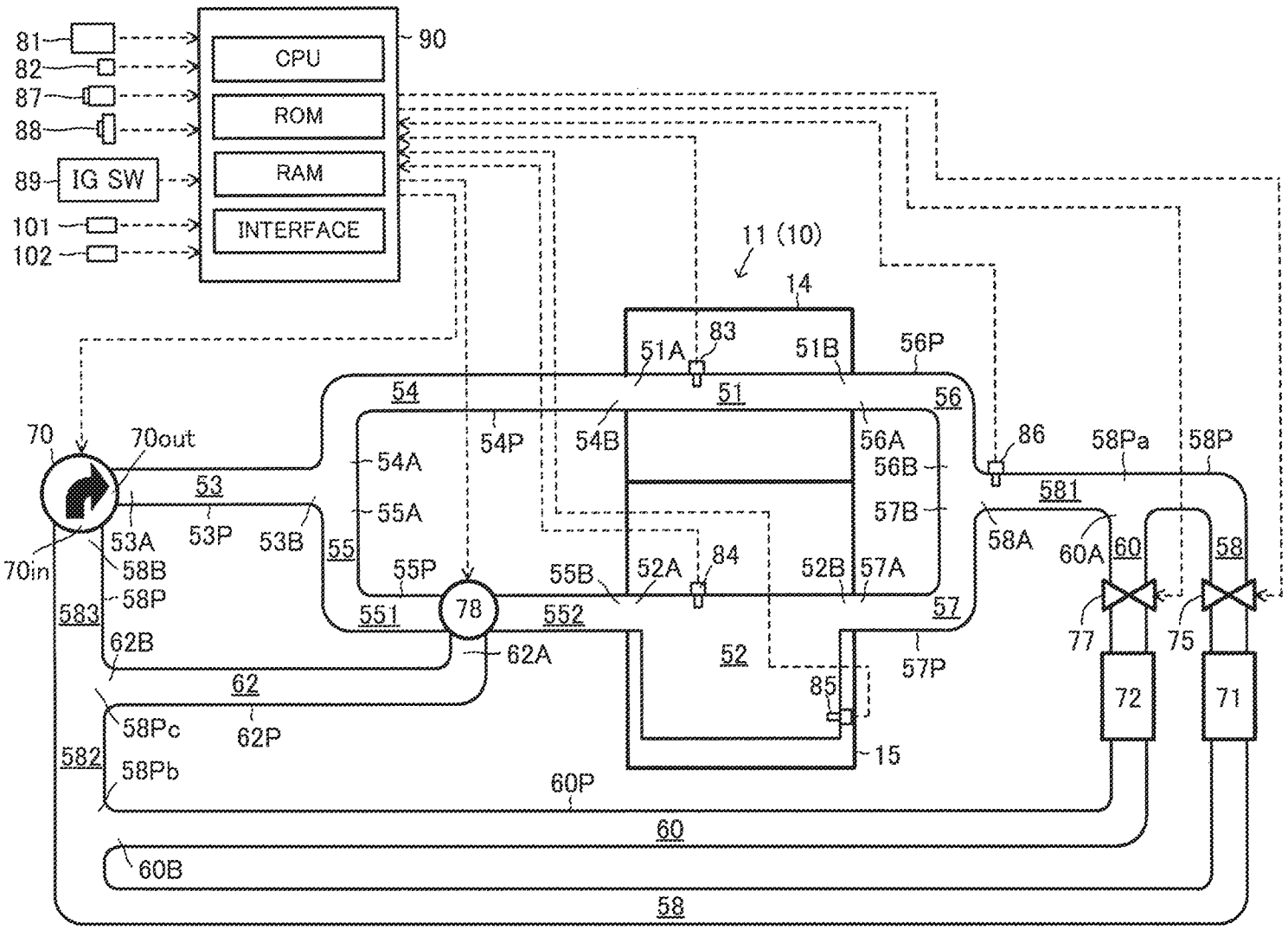
FIG. 2 is a view for showing the cooling apparatus according to the embodiment.

As shown in FIG. 2, a water passage 51 is formed in the cylinder head 14 in a known matter. The cooling water for cooling the cylinder head 14 flows through the water passage 51. Hereinafter, the water passage 51 will be referred to as "the head water passage 51." The head water passage 51 is one of elements of the embodiment apparatus. Hereinafter, the water passage is a passage through which the cooling water flows.

A water passage 52 is formed in the cylinder block 15 in a known matter. The cooling water for cooling the cylinder block 15 flows through the water passage 52. Hereinafter, the water passage 52 will be referred to as "the block water passage 52." In particular, the block water passage 52 is formed from an area near the cylinder head 14 to an area remote from the cylinder head 14 along cylinder bores defining the cylinders 12, thereby cooling the cylinder bores. The block water passage 52 is one of the elements of the embodiment apparatus.

The embodiment apparatus includes a pump 70. The pump 70 is driven by rotation of a crank shaft (not shown) of the engine 10.

The pump 70 has a suctioning opening 70in and a discharging opening 70out. The cooling water is suctioned into the pump 70 through the suctioning opening 70in. The suctioned cooling water is discharged from the pump 70 through the discharging opening 70out. Hereinafter, the suctioning opening 70in will be referred to as "the pump suctioning opening 70in", and the discharging opening 70out will be referred to as "the pump discharging opening 70out."

A cooling water pipe 53P defines a water passage 53. The cooling water pipe 53P is connected to the pump discharging opening 70out at a first end 53A thereof. Therefore, the cooling water discharged via the pump discharging opening 70out flows into the water passage 53.

A cooling water pipe 54P defines a water passage 54. A cooling water pipe 55P defines a water passage 55. A first end 54A of the cooling water pipe 54P and a first end 55A of the cooling water pipe 55P are connected to a second end 53B of the cooling water pipe 53P.

A second end 54B of the cooling water pipe 54P is connected to the cylinder head 14 such that the water passage 54 communicates with a first end 51A of the head water passage 51. A second end 55B of the cooling water pipe 55P is connected to the cylinder block 15 such that the water passage 55 communicates with a first end 52A of the block water passage 52.

A cooling water pipe 56P defines a water passage 56. A first end 56A of the cooling water pipe 56P is connected to the cylinder head 14 such that the water passage 56 communicates with a second end 51B of the head water passage 51.

A cooling water pipe 57P defines a water passage 57. A first end 57A of the cooling water pipe 57P is connected to the cylinder block 15 such that the water passage 57 communicates with a second end 52B of the block water passage 52.

A cooling water pipe 58P defines a water passage 58. A first end 58A of the cooling water pipe 58P is connected to a second end 56B of the cooling water pipe 56P and a second end 57B of the cooling water pipe 57P. A second end 58B of the cooling water pipe 58P is connected to the pump suctioning opening 70in. The cooling water pipe 58P is provided such that the cooling water pipe 58P passes through a radiator 71. Hereinafter, the water passage 58 will be referred to as "the radiator water passage 58."

The radiator 71 exchanges the heat between the cooling water passing through the radiator 71 and an outside air, thereby lowering the temperature of the cooling water.

A shut-off valve 75 is provided in the cooling water pipe 58P between the first end 58A of the cooling water pipe 58P and the radiator 71. When the shut-off valve 75 is set to an opening position, the shut-off valve 75 permits the cooling water to flow through the radiator water passage 58. On the other hand, when the shut-off valve 75 is set to a closed position, the shut-off valve 75 shuts off a flow of the cooling water through the radiator water passage 58.

A cooling water pipe 60P defines a water passage 60. A first end 60A of the cooling water pipe 60P is connected to a first portion 58Pa of the cooling water pipe 58P between the first end 58A of the cooling water pipe 58P and the shut-off valve 75. The cooling water pipe 60P is provided such that the cooling water pipe 60P passes through a thermal device 72. Hereinafter, the water passage 60 will be referred to as "the thermal device water passage 60", and a portion 581 of the radiator water passage 58 between the first end 58A of the cooling water pipe 58P and the first portion 58Pa of the cooling water pipe 60P, will be referred to as "the first portion 581 of the radiator water passage 58."

The thermal device 72 includes the EGR cooler 43 and a heater core (not shown). When the temperature of the cooling water passing through the heater core is higher than a temperature of the heater core, the heater core is warmed by the cooling water, thereby storing heat. Therefore, the heater core is a heat exchanger for exchanging the heat with the cooling water. In particular, the heater core is a heat exchanger for removing the heat from the cooling water. The heat stored in the heater core is used for warming an interior of a vehicle having the engine 10.

A shut-off valve 77 is provided in the cooling water pipe 60P between the thermal device 72 and the first end 60A of the cooling water pipe 60P. When the shut-off valve 77 is set to an opening position, the shut-off valve 77 permits the cooling water to flow through the thermal device water passage 60. On the other hand, when the shut-off valve 77 is set to a closed position, the shut-off valve 77 shuts off a flow of the cooling water through the thermal device water passage 60.

A second end 60B of the cooling water pipe 60P is connected to a second portion Pb of the cooling water pipe 58P between the radiator 71 and the pump suctioning opening 70in.

A cooling water pipe 62P defines a water passage 62. A first end 62A of the cooling water pipe 62P is connected to a switching valve 78 provided in the cooling water pipe 55P. A second end 62B of the cooling water pipe 62P is connected to a third portion 58Pc of the cooling water pipe 58P between the second portion 58Pb of the cooling water pipe 58P and the pump suctioning opening 70in.

Hereinafter, a portion 551 of the water passage 55 between the switching valve 78 and the first end 55A of the cooling water pipe 55P will be referred to as "the first portion 551 of the water passage 55." Further, a portion 552 of the water passage 55 between the switching valve 78 and the second end 55B of the cooling water pipe 55P will be referred to as "the second portion 552 of the water passage 55." Further, a portion 582 of the radiator water passage 58 between the second portion 58Pb of the cooling water pipe 58P and the third portion 58Pc of the cooling water pipe 58P will be referred to as "the second portion 582 of the water passage 58." Further, a portion 583 of the radiator water passage 58 between the third portion 58Pc of the cooling water pipe 58P and the pump suctioning opening 70in will be referred to as "the third portion 583 of the water passage 58."

When the switching valve 78 is set to a first position, the switching valve 78 permits the cooling water to flow between the first portion 551 of the water passage 55 and the second portion 552 of the water passage 55 and shuts off a flow of the cooling water between the first portion 551 of the water passage 55 and the water passage 62 and a flow of the cooling water between the second portion 552 of the water passage 55 and the water passage 62. Hereinafter, the first position of the switching valve 78 will be referred to as "the normal flow position."

When the switching valve 78 is set to the normal flow position, the embodiment apparatus controls a flow rate of the cooling water flowing into the second portion 552 of the water passage 55 from the first portion 551 of the water passage 55 through the switching valve 78 by changing an opening degree of the switching valve 78. In this case, the flow rate of the cooling water flowing through the switching valve 78 increases as the opening degree of the switching valve 78 increases when a discharging flow rate of the pump 70 is constant.

When the switching valve 78 is set to a second position, the switching valve 78 permits the cooling water to flow between the second portion 552 of the water passage 55 and the water passage 62 and shuts off the flow of the cooling water between the first portion 551 of the water passage 55 and the water passage 62 and a flow of the cooling water between the first and second portions 551 and 552 of the water passage 55. Hereinafter, the second position of the switching valve 78 will be referred to as "the opposite flow position."

When the switching valve 78 is set to the opposite flow position, the embodiment apparatus controls the flow rate of the cooling water flowing into the water passage 62 from the second portion 552 of the water passage 55 through the switching valve 78 by changing the opening degree of the switching valve 78. In this case, the flow rate of the cooling water flowing through the switching valve 78 increases as the opening degree of the switching valve 78 increases when a discharging flow rate of the pump 70 is constant.

When the switching valve 78 is set to a third position, the switching valve 78 shuts off the flow of the cooling water between the first and second portions 551 and 552 of the water passage 55, the flow of the cooling water between the first portion 551 of the water passage 55 and the water passage 62 and the flow of the cooling water between the second portion 552 of the water passage 55 and the water passage 62. Hereinafter, the third position of the switching valve 78 will be referred to as "the shut-off position."

The head water passage 51 is a first water passage formed in the cylinder head 14. The block water passage 52 is a second water passage formed in the cylinder block 15. The water passages 53 and 54 define a third water passage for connecting the first end 51A corresponding to one end of the head water passage 51 (i.e., the first water passage) to the pump discharging opening 70out.

The water passages 53, 55, and 62, the third portion 583 of the radiator water passage 58, and the switching valve 78 configure a connection switching mechanism for switching a pump connection between a normal connection of the first end 52A of the block water passage 52 to the pump discharging opening 70out and an opposite connection of the first end 52A of the block water passage 52 to the pump suctioning opening 70in. The pump connection is a connection of the first end 52A corresponding to one end of the block water passage 52, i.e., the second water passage to the pump 70.

The water passages 56 and 57 define a fourth water passage for connecting the second end 51B corresponding to the other end of the head water passage 51, i.e., the first water passage to the second end 52B corresponding to the other end of the block water passage 52, i.e., the second water passage.

The radiator water passage 58 is a fifth water passage for connecting the water passages 56 and 57 (i.e., the fourth water passage) to the pump suctioning opening 70in. The shut-off valve 75 is a shut-off valve for shutting off and opening the radiator water passage 58 (i.e., the fifth water passage).

The thermal device water passage 60 is a sixth water passage for connecting the water passages 56 and 57 (i.e., the fourth water passage) to the pump suctioning opening 70in. The shut-off valve 77 is a valve for shutting off and opening the thermal device water passage 60 (i.e., the sixth water passage).

The water passages 53 and 55 define a normal connection water passage for connecting the first end 52A of the block water passage 52 (i.e., the second water passage) to the pump discharging opening 70out. The second portion 552 of the water passage 55, the water passage 62, and the third portion 583 of the radiator water passage 58 define an opposite connection water passage for connecting the first end 52A of the block water passage 52 (i.e., the second water passage) to the pump suctioning opening 70in.

The switching valve 78 is a switching part selectively set to any of the normal flow position for connecting the first end 52A of the block water passage 52 (i.e., the second water passage) to the pump discharging opening 70out via the water passages 53 and 55 (i.e., the normal connection water passage) and the opposite flow position for connecting the first end 52A of the block water passage 52 (i.e., the second water passage) to the pump suctioning opening 70in via the second portion 552 of the water passage 55, the water passage 62, and the fourth portion 584 of the radiator water passage 58 (i.e., the opposite connection water passage).

In other words, the switching valve 78 is a switching part for switching the water passage between the normal and opposite connection water passages. As described above, the normal connection water passage is defined by the water passages 53 and 55 for connecting the first end 52A of the block water passage 52 (i.e., the second water passage) to the pump discharging opening 70out. The opposite connection water passage is defined by the second portion 552 of the water passage 55, the water passage 62, and the third portion 583 of the radiator water passage 58 for connecting the first end 52A of the block water passage 52 (i.e., the second water passage) to the pump suctioning opening 70in.

The embodiment apparatus has the ECU 90. The ECU 90 is an electronic control circuit. The ECU 90 includes a micro-computer as a main component part. The micro-computer includes a CPU, a ROM, a RAM, an interface and the like. The CPU executes instructions or routines stored in a memory such as the ROM, thereby realizing various functions described later.

As shown in FIG. 1 and FIG. 2, the ECU 90 is connected to an air-flow meter 81, a crank angle sensor 82, water temperature sensors 83 to 86, an outside air temperature sensor 87, a heater switch 88, an ignition switch 89, an acceleration pedal operation amount sensor 101, and a vehicle speed sensor 102.

The air-flow meter 81 is provided in the intake pipe 22 upstream of the compressor 24*a*. The air-flow meter 81 measures a mass flow rate Ga of an air passing therethrough and sends a signal for expressing the mass flow rate Ga to the ECU 90. Hereinafter, the mass flow rate Ga will be referred to as "the intake air amount Ga." The ECU 90 acquires the intake air amount Ga on the basis of the signal sent from the air-flow meter 81. In addition, the ECU 90 acquires a total amount ΣGa on the basis of the intake air amount Ga. The total amount ΣGa corresponds to an amount of the air suctioned into the cylinders 12*a* to 12*d* after the ignition switch 89 is set to an ON position. Hereinafter, the total amount ΣGa will be referred to as "the after-engine-start integrated air amount ΣGa."

The crank angle sensor 82 is provided on the engine body 11 adjacent to a crank shaft (not shown) of the engine 10. The crank angle sensor 82 outputs a pulse signal each time the crank shaft rotates by a constant angle (in this embodiment, 10°). The ECU 90 acquires a crank angle (i.e., an absolute crank angle) of the engine 10 on the basis of the pulse signals and signals sent from a cam position sensor (not shown). The absolute crank angle at a compression top dead center of predetermined one of the cylinders 12, is set to zero. In addition, the ECU 90 acquires an engine speed NE on the basis of the pulse signals sent from the crank angle sensor 82.

The water temperature sensor 83 is provided in the cylinder head 14 such that the water temperature sensor 83 detects a temperature TWhd of the cooling water in the head water passage 51. The water temperature sensor 83 detects the temperature TWhd and sends a signal expressing the temperature TWhd to the ECU 90. Hereinafter, the temperature TWhd will be referred to as "the head water temperature TWhd." The ECU 90 acquires the head water temperature TWhd on the basis of the signal sent from the water temperature sensor 83.

The water temperature sensor 84 is provided in the cylinder block 15 such that the water temperature sensor 84 detects a temperature TWbr_up of the cooling water in the block water passage 52 near the cylinder head 14. The water temperature sensor 84 detects the temperature TWbr_up and sends a signal expressing the temperature TWbr_up to the ECU 90. Hereinafter, the temperature TWbr_up will be referred to as "the upper block water temperature TWbr_up." The ECU 90 acquires the upper block water temperature TWbr_up on the basis of the signal sent from the water temperature sensor 84.

The water temperature sensor 85 is provided in the cylinder block 15 such that the water temperature sensor 85 detects a temperature TWbr_low of the cooling water in the block water passage 52 remote from the cylinder head 14. The water temperature sensor 85 detects the temperature TWbr_low and sends a signal expressing the temperature TWbr_low to the ECU 90. Hereinafter, the temperature TWbr_low will be referred to as "the lower block water temperature TWbr_low." The ECU 90 acquires the lower block water temperature TWbr_low on the basis of the signal sent from the water temperature sensor 85. The ECU 90 acquires a difference ΔTWbr of the lower block water temperature TWbr_low with respect to the upper block water temperature TWbr_up (ΔTWbr=TWbr_up−TWbr_low). Hereinafter, the difference ΔTWbr will be referred to as "the block water temperature difference ΔTWbr."

The water temperature sensor 86 is provided in a portion of the cooling water pipe 58P defining the first portion 581 of the radiator water passage 58. The water temperature sensor 86 detects a temperature TWeng of the cooling water in the first portion 581 of the radiator water passage 58 and sends a signal expressing the temperature TWeng to the ECU 90. Hereinafter, the temperature TWeng will be referred to as "the engine water temperature TWeng." The ECU 90 acquires the engine water temperature TWeng on the basis of the signal sent from the water temperature sensor 86.

The outside air temperature sensor 87 detects a temperature Ta of the outside air and sends a signal expressing the temperature Ta. Hereinafter, the temperature Ta will be referred to as "the outside air temperature Ta." The ECU 90 acquires the outside air temperature Ta on the basis of the signal sent from the outside air temperature sensor 87.

The heater switch 88 is operated by a driver of the vehicle having the engine 10. When the heater switch 88 is set to an ON position by the driver, the ECU 90 causes the heater core to discharge the heat stored to the interior of the vehicle. On the other hand, when the heater switch 88 is set to an OFF position by the driver, the ECU 90 causes the heater core to stop discharging the heat to the interior of the vehicle.

The ignition switch 89 is operated by the driver of the vehicle. When the driver sets the ignition switch 89 to an ON position, the operation of the engine 10 is permitted to start. On the other hand, when the driver sets the ignition switch 89 to an OFF position, the operation of the engine 10 is stopped. Hereinafter, an operation of setting the ignition switch 89 to the ON position by the driver will be referred to as "the ignition ON operation." Further, an operation of setting the ignition switch 89 to the OFF position by the driver will be referred to as "the ignition OFF operation." Further, the operation of the engine 10 will be referred to as "the engine operation."

The acceleration pedal operation amount sensor 101 detects an operation amount AP of an acceleration pedal (not shown) and sends a signal expressing the operation amount AP to the ECU 90. Hereinafter, the operation amount AP will be referred to as "the acceleration pedal operation amount AP." The ECU 90 acquires the acceleration pedal operation amount AP on the basis of the signal sent from the acceleration pedal operation amount sensor 101.

The vehicle speed sensor 102 detects a moving speed V of the vehicle having the engine 10 and sends a signal expressing the moving speed V. Hereinafter, the moving speed V will be referred to as "the vehicle speed V." The ECU 90 acquires the vehicle speed V on the basis of the signal sent from the vehicle speed sensor 102.

Further, the ECU 90 is connected to the throttle valve actuator 27, the EGR control valve 42, the pump 70, the shut-off valves 75 and 77, and the switching valve 78.

The ECU 90 sets a target value of the opening degree of the throttle valve 26, depending on an engine operation state and controls the activation of the throttle valve actuator 27 such that the opening degree of the throttle valve 26 corresponds to the target value. The engine operation state is defined by an engine load KL and the engine speed NE.

The ECU 90 sets a target value EGRtgt of the opening degree of the EGR control valve 42, depending on the engine operation state and controls the activation of the EGR control valve 42 such that the opening degree of the EGR control valve 42 corresponds to the target value EGRtgt. Hereinafter, the target value EGRtgt will be referred to as "the target EGR control valve opening degree EGRtgt."

Figure 3:
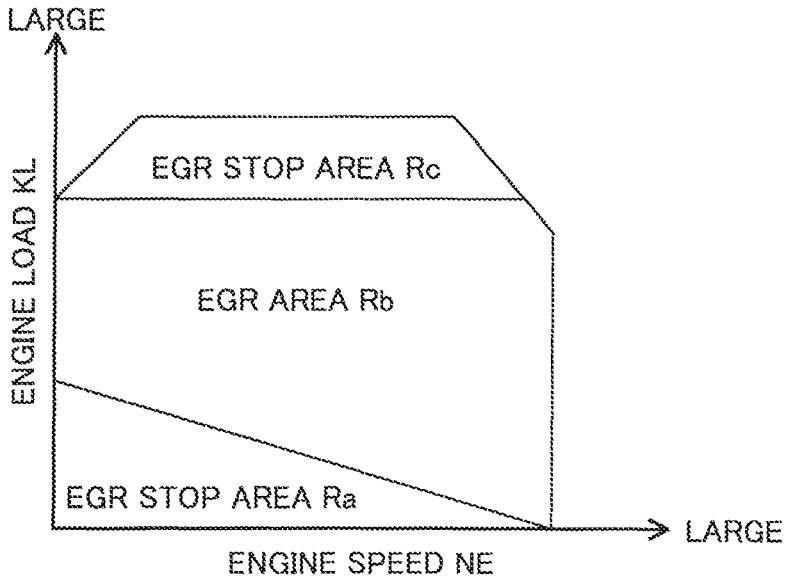
FIG. 3 is a view for showing a map used for controlling an EGR control valve shown in FIG. 1.

The ECU 90 stores a map shown in FIG. 3. When the engine operation state is in an EGR stop area Ra or Rc shown in FIG. 3, the ECU 90 sets the target EGR control valve opening degree EGRtgt to zero. In this case, no EGR gas is supplied to the cylinders 12.

On the other hand, when the engine operation state is in an EGR area Rb shown in FIG. 3, the ECU 90 sets the target EGR control valve opening degree EGRtgt to a value larger than zero, depending on the engine operation state. In this case, the EGR gas is supplied to the cylinders 12.

As described later, the ECU 90 controls activations of the pump 70, the shut-off valves 75 and 77, and the switching valve 78, depending on a temperature Teng of the engine 10. Hereinafter, the temperature Teng will be referred to as "the engine temperature Teng."

<Summary of Activation of Embodiment Apparatus>

Next, a summary of an activation of the embodiment apparatus will be described. The embodiment apparatus executes any of activation controls A to F described later, depending on a warmed state of the engine 10, presence or absence of an EGR cooler water supply request (i.e., a thermal device water supply request) described later, and presence or absence of a heater core water supply request (i.e., the thermal device water supply request) described later. Hereinafter, the warmed state of the engine 10 will be simply referred to as the warmed state."

A method for determining the warmed state will be described. When an after-engine-start cycle number Cig is equal to or smaller than a predetermined after-engine-start cycle number Cig_th, the embodiment apparatus determines which one of a cool state, a semi-warmed state, and a completely-warmed state, the warmed state is, on the basis of the engine water temperature TWeng correlating with the engine temperature Teng as described later. Hereinafter, the cool state, the semi-warmed state, and the completely-warmed state will be collectively referred to as "the cool state and the like." The after-engine-start cycle Cig is the number of cycles counted after the engine operation starts. In this embodiment, the predetermined after-engine-start cycle number Cig_th is two to three cycles which corresponds to eight to twelve combustion strokes of the engine 10.

The cool state is a state that the engine temperature Teng is estimated to be lower than a predetermined threshold temperature Teng1. Hereinafter, the predetermined threshold temperature Teng1 will be referred to as "the first engine temperature Teng1."

The semi-warmed state is a state that the engine temperature Teng is estimated to be equal to or higher than the first engine temperature Teng1 and to be lower than a predetermined threshold temperature Teng2. Hereinafter, the predetermined threshold temperature Teng2 will be referred to as "the second engine temperature Teng2." The second engine temperature Teng2 is set to a temperature higher than the first engine temperature Teng1.

The completely-warmed state is a state that the engine temperature Teng is estimated to be equal to or larger than the second engine temperature Teng2.

The embodiment apparatus determines that the warmed state is the cool state when the engine water temperature TWeng is lower than a predetermined threshold water temperature TWeng1. The predetermined threshold water temperature TWeng1 is, in this embodiment, 40 degrees and hereinafter, will be referred to as "the first engine water temperature TWeng1."

The embodiment apparatus determines that the warmed state is the semi-warmed state when the engine water temperature TWeng is equal to or higher than the first engine water temperature TWeng1 and lower than a predetermined threshold water temperature TWeng2. The predetermined threshold water temperature TWeng2, in this embodiment, 60 degrees and hereinafter, will be referred to as "the second engine water temperature TWeng2." The second engine water temperature TWeng2 is set to a temperature higher than the first engine water temperature TWeng1.

The embodiment apparatus determines that the warmed state is the completely-warmed state when the engine water temperature TWeng is equal to or higher than the second engine water temperature TWeng2.

On the other hand, when the after-engine-start cycle number Cig is larger than the predetermined after-engine-start cycle number Cig_th, the embodiment apparatus determines which one of the cool state and the like, the warmed state is on the basis of at least four of the upper block water temperature TWbr_up, the head water temperature TWhd, the block water temperature difference ΔTWbr, the after-engine-start integrated air amount ΣGa, and the engine water temperature TWeng which correlate with the engine temperature Teng.

<Cool Condition>

In particular, the embodiment apparatus determines that the warmed state is the cool state when at least one of conditions C1 to C4 described below is satisfied.

The condition C1 is a condition that the upper block water temperature TWbr_up is equal to or lower than a predetermined threshold water temperature TWbr_up1. Hereinafter, the predetermined threshold water temperature TWbr_up1 will be referred to as "the first upper block water temperature TWbr_up1" The upper block water temperature TWbr_up is a parameter correlating with the engine temperature Teng. Therefore, the embodiment apparatus can determine which one of the cool state and the like, the warmed state is on the basis of the upper block water temperature TWbr_up with the appropriately-set first upper block water temperature TWbr_up1 and appropriately-set water temperature thresholds described later.

The condition C2 is a condition that the head water temperature TWhd is equal to or lower than a predetermined threshold water temperature TWhd1. Hereinafter, the predetermined threshold water temperature TWhd1 will be referred to as "the first head water temperature TWhd1." The head water temperature TWhd is the parameter correlating with the engine temperature Teng. Therefore, the embodiment apparatus can determine which one of the cool state and the like, the warmed state is on the basis of the head water temperature TWhd with the appropriately-set first head water temperature TWhd1 and appropriately-set water temperature thresholds described later.

The condition C3 is a condition that the after-engine-start integrated air amount ΣGa is equal to or smaller than a predetermined threshold air amount ΣGa1. Hereinafter, the predetermined threshold air amount ΣGa1 will be referred to as "the first air amount ΣGa1." As described above, the after-engine-start integrated air amount ΣGa is the amount of the air suctioned into the cylinders 12*a* to 12*d* after the ignition switch 89 is set to the ON position. When a total amount of the air suctioned into the cylinders 12*a* to 12*d* increases, a total amount of the fuel supplied to the cylinders 12*a* to 12*d* from the fuel injectors 13 increases. As a result, a total amount of heat generated in the cylinders 12*a* to 12*d* increases. Thus, before the after-engine-start integrated air amount ΣGa reaches a certain amount, the engine temperature Teng increases as the after-engine-start integrated air amount ΣGa increases. Therefore, the after-engine-start integrated air amount ΣGa is a parameter correlating with the engine temperature Teng. Therefore, the embodiment apparatus can determine which one of the cool state and the like, the warmed state is on the basis of the after-engine-start integrated air amount Ga with the appropriately-set first air amount ΣGa1 and appropriately-set air amount thresholds described later.

The condition C4 is a condition that the engine water temperature TWeng is equal to or lower than a predetermined threshold water temperature TWeng4. Hereinafter, the predetermined threshold water temperature TWeng4 will be referred to as "the fourth engine water temperature TWeng4." The engine water temperature TWeng is the parameter correlating with the engine temperature Teng. Therefore, the embodiment apparatus can determine which one of the cool state and the like, the warmed state is on the basis of the engine water temperature TWeng with the appropriately-set fourth engine water temperature TWeng4 and appropriately-set water temperature thresholds described later.

The embodiment apparatus may be configured to determine that the warmed state is the cool state when at least two or three or all of the conditions C1 to C4 are satisfied.

<Semi-Warmed Condition>

The embodiment apparatus determines that the warmed state is the semi-warmed state when at least one of conditions C5 to C9 described below is satisfied.

The condition C5 is a condition that the upper block water temperature TWbr_up is higher than the first upper block water temperature TWbr_up1 and equal to or lower than a predetermined threshold water temperature TWbr_up2. Hereinafter, the predetermined threshold water temperature TWbr_up2 will be referred to as "the second upper block water temperature TWbr_up2." The second upper block water temperature TWbr_up2 is set to a temperature higher than the first upper block water temperature TWbr_up1.

The condition C6 is a condition that the head water temperature TWhd is higher than the first head water temperature TWhd1 and equal to or lower than a predetermined threshold water temperature TWhd2. Hereinafter, the predetermined threshold water temperature TWhd2 will be referred to as "the second head water temperature TWhd2." The second head water temperature TWhd2 is set to a temperature higher than the first head water temperature TWhd1.

The condition C7 is a condition that the block water temperature difference ΔTWbr is larger than a predetermined threshold ΔTWbrth. As described above, the block water temperature difference ΔTWbr is the difference between the upper and lower block water temperatures TWbr_up and TWbr_low (ΔTWbr=TWbr_up−TWbr_low). In the cool state immediately after the engine 10 starts by the ignition switch ON operation, the block water temperature difference ΔTWbr is not much large. In the semi-warmed state, the block water temperature difference ΔTWbr increases temporarily while the engine temperature Teng increases. Then, in the semi-warned state, the block water temperature difference ΔTWbr decreases. Thus, the block water temperature difference ΔTWbr is a parameter correlating with the engine temperature Teng, in particular, when the warmed state is the semi-warmed state. Therefore, the embodiment apparatus can determine whether the warmed state is the semi-warmed state on the basis of the block water temperature difference ΔTWbr with the appropriately-set predetermined threshold ΔTWbrth.

The condition C8 is a condition that the after-engine-start integrated air amount ΣGa is larger than the first air amount ΣGa1 and equal to or smaller than a predetermined threshold air amount ΣGa2. Hereinafter, the predetermined threshold air amount ΣGa2 will be referred to as "the second air amount ΣGa2." The second air amount ΣGa2 is set to a value larger than the first air amount ΣGa1.

The condition C9 is a condition that the engine water temperature TWeng is higher than the engine water temperature TWeng 4 and equal to or lower than a predetermined threshold water temperature TWeng5. Hereinafter, the predetermined threshold water temperature TWeng5 will be referred to as "the fifth engine water temperature TWeng5." The fifth engine water temperature TWeng5 is set to a temperature higher than the fourth engine water temperature TWeng4.

The embodiment apparatus may be configured to determine that the warmed state is the semi-warmed state when at least two or three or four or all of the conditions C5 to C9 are satisfied.

<Complete Warmed Condition>

The embodiment apparatus determines that the warmed state is the completely-warmed state when at least one of conditions C14 to C17 described below is satisfied.

The condition C14 is a condition that the upper block water temperature TWbr_up is higher than the second upper block water temperature TWbr_up2.

The condition C15 is a condition that the head water temperature TWhd is higher than the second upper block water temperature TWhd2.

The condition C16 is a condition that the after-engine-start integrated air amount ΣGa is larger than the second air amount ΣGa2.

The condition C17 is a condition that the engine water temperature TWeng is higher than the engine water temperature TWeng 6.

The embodiment apparatus may be configured to determine that the warmed state is the completely-warmed state when at least two or three or all of the conditions C14 to C17 is satisfied.

<EGR Cooler Water Supply Request>

As described above, when the engine operation state is in the EGR area Rb shown in FIG. 3, the EGR gas is supplied to the cylinders 12. When the EGR gas is supplied to the cylinders 12, it is preferred to supply the cooling water to the thermal device water passage 60, thereby cooling the EGR gas by the cooling water at the EGR cooler 43.

In this regard, when the EGR gas is cooled by the cooling water having a too low temperature at the EGR cooler 43, water in the EGR gas may be condensed in the exhaust gas recirculation pipe 41. The condensed water may corrode the exhaust gas recirculation pipe 41. Therefore, when the temperature of the cooling water is too low, it is preferred not to supply the cooling water to the thermal device water passage 60.

The embodiment apparatus determines that a supply of the cooling water to the thermal device water passage 60 is requested when the engine operation state is in the EGR area Rb, and the engine water temperature TWeng is higher than a predetermined threshold water temperature TWeng7 (in this embodiment, 60° C.). Hereinafter, a request of the supply of the cooling water to the thermal device water passage 60 will be referred to as "the EGR cooler water supply request." Further, the predetermined threshold water temperature TWeng7 will be referred to as "the seventh engine water temperature TWeng7."

Further, even though the engine water temperature TWeng is equal to or lower than the seventh engine water temperature TWeng7, the engine temperature Teng is expected to increase immediately when the engine load KL is relatively large. As a result, the engine water temperature TWeng is expected to become higher than the seventh engine water temperature TWeng7 immediately. Therefore, when the cooling water is supplied to the thermal device water passage 60, an amount of the condensed water generated, is small, and the exhaust gas recirculation pipe 41 is unlikely to be corroded.

Accordingly, even though the engine operation state is in the EGR area Rb, and the engine water temperature TWeng is equal to or lower than the seventh engine water temperature TWeng7, the embodiment apparatus determines that the EGR cooler water supply is requested when the engine load KL is equal to or larger than a predetermined threshold engine load KLth. Therefore, the embodiment apparatus determines that the EGR cooler water supply is not requested when the engine load KL is smaller than the threshold engine load KLth while the engine operation state is in the EGR area Rb, and the engine water temperature TWeng is equal to or lower than the seventh engine water temperature TWeng7.

On the other hand, when the engine operation state is in the EGR stop area Ra or Rc shown in FIG. 3, no EGR gas is supplied to the cylinders 12. Thus, the cooling water does not need to be supplied to the thermal device water passage 60. Accordingly, the embodiment apparatus determines that the EGR cooler water supply is not requested when the engine operation state is in the EGR stop area Ra or Rc shown in FIG. 3.

<Heater Core Water Supply Request>

The heater core removes the heat of the cooling water flowing through the thermal device water passage 60 to decrease the temperature of the cooling water. As a result, the complete warming of the engine 10 is delayed. In this regard, when the outside air temperature Ta is relatively low, the temperature of the interior of the vehicle is also relatively low. Therefore, the persons including the driver in the vehicle (hereinafter, will be referred to as the driver and the like) is likely to request a warming of the interior of the vehicle. Thus, even though the warming of the engine 10 is delayed due to the outside air temperature Ta being relatively low, it is preferred to flow the cooling water through the thermal device water passage 60 to increase the amount of the heat stored in the heater core in preparation for a request of the warming of the interior of the vehicle.

Accordingly, when the outside air temperature Ta is relatively low, the embodiment apparatus determines that a supply of the cooling water to the thermal device water passage 60 is requested, independently of a set state of the heater switch 88 even though the engine temperature Teng is relatively low. A request of the supply of the cooling water to the thermal device water passage 60 is the heater core water supply request described above. In this regard, when the engine temperature Teng is greatly low, the embodiment apparatus determines that the supply of the cooling water to the thermal device water passage 60 is not requested. Hereinafter, the supply of the cooling water to the thermal device water passage 60 will be referred to as "the heater core water supply."

In particular, the embodiment apparatus determines that the heater core water supply is requested when the engine water temperature TWeng is higher than a predetermined threshold water temperature TWeng8 while the outside air temperature Ta is equal to or lower than a predetermined threshold temperature Tath. Hereinafter, the predetermined threshold water temperature TWeng8 will be referred to as "the eighth engine water temperature TWeng8", and the predetermined threshold temperature Tath will be referred to as "the threshold temperature Tath." In this embodiment, the eighth engine water temperature TWeng8 is, for example, 10° C.

On the other hand, when the engine water temperature TWeng is equal to or lower than the eighth engine water temperature TWeng8 while the outside air temperature Ta is equal to or lower than the threshold temperature Tath, the embodiment apparatus determines that the heater core water supply is not requested.

When the outside air temperature Ta is relatively high, the temperature of the interior of the vehicle is also relatively high. Thus, the driver and the like may not request the warming of the interior of the vehicle. Therefore, it is sufficient to flow the cooling water through the thermal device water passage 60 to warm the heater core only when the engine temperature Teng is relatively high, and the heater switch 88 is set to the ON position while the outside air temperature Ta is relatively high.

Accordingly, the embodiment apparatus determines that the heater core water supply is requested when the engine temperature Teng is relatively high, and the heater switch 88 is set to the ON position while the outside air temperature Ta is relatively high. On the other hand, when the engine temperature Teng is relatively low or the heater switch 88 is set to the OFF position while the outside air temperature Ta is relatively high, the embodiment apparatus determines that the heater core water supply is not requested.

In particular, the embodiment apparatus determines that the heater core water supply is requested when the heater switch 88 is set to the ON position, and the engine water temperature TWeng is higher than a predetermined threshold water temperature TWeng9 while the outside air temperature Ta is higher than the threshold temperature Tath. Hereinafter, the predetermined threshold water temperature TWeng9 will be referred to as "the ninth engine water temperature TWeng9." The ninth engine water temperature TWeng9 is set to a value higher than the eighth engine water temperature TWeng8. In this embodiment, the ninth engine water temperature TWeng9 is, for example, 30° C.

On the other hand, when the heater switch 88 is set to the OFF position or the engine water temperature TWeng is equal to or lower than the ninth engine water temperature TWeng9 while the outside air temperature Ta is higher than the threshold temperature Tath, the embodiment apparatus determines that the heater core water supply is not requested.

Next, activation controls of the pump 70, the shut-off valves 75 and 77, and the switching valve 78 executed by the embodiment apparatus will be described. Hereinafter, the pump 70, the shut-off valves 75 and 77, and the switching valve 78 will be collectively referred to as "the pump 70 and the like." As shown in FIG. 4, the embodiment apparatus executes any of the activation controls A to F, depending on the warmed state, the presence or absence of the EGR cooler water supply request (i.e., the thermal device water supply request), and the presence or absence of the heater core water supply request (i.e., the thermal device water supply request).

<Cool State Control>

First, a cool state control corresponding to the activation control of the pump 70 and the like will be described. The cool state control is executed when the embodiment apparatus determines that the warmed state is the cool state.

<Activation Control A>

When the warmed state is the cool state, the embodiment apparatus should cause the head and block temperatures Thd and Tbr to increase at the large rate. In this regard, when the warmed state is the cool state while the EGR cooler water supply and the heater core water supply are not requested, the embodiment apparatus may cause the head and block temperatures Thd and Tbr to increase at the large rate by stopping the activation of the pump 70, thereby stopping the supply of the cooling water to the head and block water passages 51 and 52. Therefore, the embodiment apparatus can cause the head and block temperatures Thd and Tbr to increase at the large rate by stopping the activation of the pump 70.

In this regard, when the pump 70 is not activated, the cooling water stays in the head and block water passages 51 and 52. As a result, the temperature of a part of the cooling water may increase to an extremely high temperature in the head and block water passages 51 and 52. Thus, the cooling water may boil in the head and block water passages 51 and 52.

Accordingly, when the EGR cooler water supply and the heater core water supply are not requested while the warmed state is the semi-warmed state, the embodiment apparatus executes the activation control A as the cool state control and an incompletely-warmed state control. According to the activation control A, the embodiment apparatus activates the pump 70, sets the shut-off valves 75 and 77 to the closed positions, respectively, and sets the switching valve 78 to the opposite flow position. When the embodiment apparatus executes the activation control A, the cooling water circulates as shown by arrows in FIG. 5.

According to the activation control A, the cooling water is discharged to the water passage 53 via the pump discharging opening 70out and then, flows into the head water passage 51 via the water passage 54. The cooling water flows through the head water passage 51 and then, flows into the block water passage 52 through the water passages 56 and 57. The cooling water flows through the block water passage 52 and then, flows through the second portion 552 of the block water passage 52, the water passage 62, and the third portion 583 of the radiator water passage 58. Then, the cooling water is suctioned into the pump 70 via the pump suctioning opening 70in.

Thereby, the cooling water is supplied from the head water passage 51 directly to the block water passage 52 without flowing through any of the radiator 71 and the thermal device 72. In this case, the temperature of the cooling water supplied to the block water passage 52, is increased since the temperature of the cooling water is increased while the cooling water flows through the head water passage 51. Thus, the block temperature Tbr increases at the large rate, compared with when the cooling water is supplied to the block water passage 52 through any of the radiator 71 and the thermal device 72. Hereinafter, the radiator 71 and the thermal device 72 will be collectively referred to as "the radiator 71 and the like."

In addition, the cooling water is supplied to the head water passage 51 without flowing through the radiator 71 and the like. Thus, when the cooling water is supplied to the head water passage 51 without flowing through the radiator 71 and the like, the head temperature Thd increases at the large rate, compared with when the cooling water is supplied to the head water passage 51 through the radiator 71 and the like.

In addition, the cooling water flows through the head and block water passages 51 and 52. The temperature of the cooling water is prevented from increasing to the greatly high temperature in the head and block water passages 51 and 52. As a result, the cooling water is prevented from boiling in the head and block water passages 51 and 52.

When the cooling water flows through the head and block water passages 51 and 52, the cylinder head 14 and the cylinder block 15 are cooled. Thereby, an increasing rate of the head temperature Thd as well as the increasing rate of the block temperature Tbr decrease. A decreasing degree of the increasing rate of the head temperature Thd increases as the flow rate of the cooling water flowing through the head water passage 51 increases. Also, the decreasing degree of the increasing rate of the block temperature Tbr increases as the flow rate of the cooling water flowing through the block water passage 52 increases. Further, when the warmed state is the semi-warmed state, it is desired to increase the head and block temperatures Thd and Tbr at the large rate for the purpose of completing the warming of the engine 10 promptly.

Accordingly, the embodiment apparatus controls the opening degree of the switching valve 78, thereby controlling the flow rate of the cooling water flowing through the head and block water passages 51 and 52 to a minimum flow rate capable of preventing the cooling water from boiling in the head and block water passages 51 and 52. Thereby, the flow rate of the cooling water is controlled to the minimum flow rate in the head and block water passages 51 and 52.

Therefore, the cooling water is prevented from boiling in the head and block water passages 51 and 52, and the head and block temperatures Thd and Tbr increases at the large rate by the embodiment apparatus executing the activation control A as the cool state control.

The embodiment apparatus may be configured to execute the activation control A as the cool state control to control the opening degree of the switching valve 78 to an opening degree capable of controlling the flow rate of the cooling water flowing through the head and block water passages 51 and 52 to a flow rate smaller than a predetermined flow rate larger than the minimum flow rate. The predetermined flow rate is set appropriately in advance.

Further, the pump 70 may be an electric pump capable of adjusting the flow rate of the cooling water discharged therefrom. In this case, the embodiment apparatus may be configured to control the flow rate of the cooling water discharged from the pump 70 and the opening degree of the switching valve 78 to a flow rate and an opening degree, respectively capable of controlling the flow rate of the cooling water flowing through the head and block water passages 51 and 52 to a flow rate smaller than the minimum flow rate or the predetermined flow rate.

<Activation Control B>

When any of the EGR cooler water supply and the heater core water supply is requested while the warmed state is the semi-warmed state, the embodiment apparatus executes the activation control B as the incompletely-warmed state control. According to the activation control B, the embodiment apparatus activates the pump 70, sets the shut-off valves 75 to the closed position, sets the shut-off valve 77 to the open position, and sets the switching valve 78 to the opposite flow position. When the embodiment apparatus executes the activation control B, the cooling water circulates as shown by arrows in FIG. 6.

According to the activation control B, the cooling water is discharged to the water passage 53 via the pump discharging opening 70out and then, flows into the head water passage 51 via the water passage 54.

A part of the cooling water flowing into the head water passage 51, flows through the head water passage 51 and then, flows into the block water passage 52 via the water passages 56 and 57. The cooling water flows through the block water passage 52 and then, flows through the second portion 552 of the water passage 55, the water passage 62, and the third portion 583 of the radiator water passage 58. Then, the cooling water is suctioned into the pump 70 via the pump suctioning opening 70in.

On the other hand, the remaining of the cooling water flowing into the head water passage 51, flows through the thermal device water passage 60 via the water passage 56 and the first portion 581 of the radiator water passage 58. The cooling water flows through the thermal device 72 and then, flows through the thermal device water passage 60, the second portion 582 of the radiator water passage 58, and the third portion 583 of the radiator water passage 58. Then, the cooling water is suctioned into the pump 70 via the pump suctioning opening 70in.

Thereby, the same effects as the effects achieved by the activation control A are achieved, and the EGR cooler water supply and/or the heater core water supply are/is accomplished in response to the EGR cooler water supply request and/or the heater core water supply request.

<Semi-Warmed State Control>

Next, a semi-warmed state control corresponding to the activation control of the pump 70 and the like will be described. The semi-warmed state control is executed when the embodiment apparatus determines that the warmed state is the semi-warmed state.

<Activation Control C>

When the warmed state is the semi-warmed state, it is requested to increase the block temperature Tbr at the large rate. When the EGR cooler water supply and the heater core water supply are not requested while the warmed state is the semi-warmed state, the embodiment apparatus should execute the activation control A only for the purpose of accomplishing a request of increasing the block temperature Tbr at the large rate, similar to when the warmed state is the cool state.

In this regard, when the warmed state is the semi-warmed state, the head and block temperatures Thd and Tbr are high compared with when the warmed state is the cool state. Therefore, if the embodiment apparatus executes the activation control A, the temperature of parts of the cooling water may increase to a greatly high temperature in the head and block water passages 51 and 52. Thus, the cooling water staying in the head and block water passages 51 and 52 may boil.

Further, when the activation control A is executed, a head cooling water flow rate is equal to a block cooling water flow rate. The head cooling water flow rate is a flow rate of the cooling water supplied to the head water passage 51. The block cooling water flow rate is a flow rate of the cooling water supplied to the block water passage 52.

When the cooling water is supplied to the head and block water passages 51 and 52, the cylinder head 14 and the cylinder block 15 are cooled. In this regard, a head-received heat amount is larger than a block-received heat amount. The head-received heat amount is an amount of heat received by the cylinder head 14 from the cylinders 12*a* to 12*d*. The block-received heat amount is an amount of heat received by the cylinder block 15 from the cylinders 12*a* to 12*d*. In this case, the increasing rate of the head temperature Thd is larger than the increasing rate of the block temperature Tbr.

Therefore, if a pump discharging flow rate is decreased to decrease the block cooling water flow rate for the purpose of increasing the block temperature Tbr at the large rate with the head cooling water flow rate being equal to the block cooling water flow rate, the head cooling water flow rate also decreases. In this regard, the pump discharging flow rate is a flow rate of the cooling water discharged from the pump 70. In this case, the head temperature Thd increases at the further large rate to an excessively high temperature. As a result, the cooling water may boil in the head water passage 51.

On the other hand, if the pump discharging flow rate increases, thereby increasing the head cooling water flow rate for the purpose of preventing the cooling water from boiling in the head water passage 51, the block cooling water flow rate also increases. In this case, the increasing rate of the block temperature Tbr decreases.

Accordingly, the embodiment apparatus executes the activation control C as the incompletely-warmed state control when the warmed state is the semi warmed state, and the EGR cooler water supply and the heater core water supply are not requested. According to the activation control C, the embodiment apparatus activates the pump 70, sets the shut-off valve 77 to the closed position, sets the shut-off valve 75 to the open position, and sets the switching valve 78 to the opposite flow position. In this case, the cooling water circulates as shown by arrows in FIG. 7. When the embodiment apparatus executes the activation control C, the embodiment apparatus sets the pump discharging flow rate to a flow rate capable of preventing the cooling water from boiling in the head water passage 51.

According to the activation control C, the cooling water is discharged to the water passage 53 via the pump discharging opening 70out and then, flows into the head water passage 51 via the water passage 54.

A part of the cooling water flowing into the head water passage 51, flows through the head water passage 51 and then, flows directly into the block water passage 52 via the water passages 56 and 57. The cooling water flows through the block water passage 52 and then, flows through the second portion 552 of the water passage 55, the water passage 62, and the third portion 583 of the radiator water passage 58. Then, the cooling water is suctioned into the pump 70 via the pump suctioning opening 70in.

On the other hand, the remaining of the cooling water flowing into the head water passage 51, flows through the radiator 71 via the water passage 56 and the radiator water passage 58. The cooling water flows through the radiator 71 and then, flows through the radiator water passage 58. Then, the cooling water is suctioned into the pump 70 via the pump suctioning opening 70in.

Thereby, a part of the cooling water flowing through the head water passage 51, flows through the radiator 71. The remaining of the cooling water flowing through the head water passage 51, flows into the block water passage 52. Therefore, the block cooling water flow rate is smaller than the head cooling water flow rate. Thus, even when the pump discharging flow rate is set to the flow rate capable of preventing the cooling water from boiling in the head water passage 51, the block temperature increases at a sufficiently large rate.

Further, the cooling water is supplied from the head water passage 51 directly to the block water passage 52 without flowing through the radiator 71. In this case, the temperature of the cooling water supplied to the block water passage 52, increases since the temperature of the cooling water increases while the cooling water flows through the head water passage 51. Thus, the increasing rate of the block temperature Tbr is large compared with when the cooling water is supplied to the block water passage 52 through the radiator 71.

Further, the cooling water is supplied to the head water passage 51 at the flow rate capable of preventing the cooling water from boiling in the head water passage 51. Thus, the cooling water is prevented from boiling in the head water passage 51.

The increasing rate of the block temperature Tbr may be smaller than the increasing rate of the head temperature Thd. Therefore, when a difference ΔTW between the head water temperature TWhd and the upper block water temperature TWbr_up is large, the block temperature Tbr may be considerably smaller than the head temperature Thd. The difference ΔTW is a difference calculated by subtracting the upper block water temperature TWbr_up from the head water temperature TWhd and hereinafter, will be referred to as "the water temperature difference ΔTW." In this case, the cylinder block 15 may not be warmed completely even when the cylinder head 14 is warmed completely. In this case, the embodiment apparatus should not determine that the warmed state changes from the semi-warmed state to the completely-warmed state on the basis of the temperature of the cooling water.

Accordingly, the embodiment apparatus executes the activation control C to causes the opening degree of the switching valve 78 to a small degree when the switching valve 78 is set to the opposite flow position, and the water temperature difference ΔTW is large, compared with when the switching valve 78 is set to the opposite flow position, and the water temperature difference ΔTW is small. In particular, the embodiment apparatus executes the activation control C such that the opening degree of the switching valve 78 decreases as the water temperature difference ΔTW increases.

Thereby, while the activation control C is executed, the flow rate of the cooling water in the block water passage 52 when the water temperature ΔTW is large, is smaller than the flow rate of the cooling water in the block water passage 52 when the water temperature ΔTW is small. Therefore, the increasing rate of the block temperature Tbr increases. Thus, the cylinder block 15 may be warmed completely when the embodiment apparatus determines that the warmed state changes from the semi-warmed state to the completely-warmed state on the basis of the temperature of the cooling water.

<Activation Control D>

When any of the EGR cooler water supply and the heater core water supply is requested is requested while the warmed state is the semi-warmed state, the embodiment apparatus executes the activation control D as the incompletely-warmed state control. According to the activation control D, the embodiment apparatus activates the pump 70, sets the shut-off valves 75 and 77 to the open positions, respectively, and sets the switching valve 78 to the opposite flow position. When the embodiment apparatus executes the activation control D, the cooling water circulates as shown by arrows in FIG. 8. When the embodiment apparatus executes the activation control D, the embodiment apparatus sets the pump discharging flow rate to the flow rate capable of preventing the cooling water from boiling in the head water passage 51.

According to the activation control D, the cooling water is discharged to the water passage 53 via the pump discharging opening 70out and then, flows into the head water passage 51 via the water passage 54.

A part of the cooling water flowing into the head water passage 51, flows through the head water passage 51 and then, flows into the block water passage 52 via the water passages 56 and 57. The cooling water flows through the block water passage 52 and then, flows through the second portion 552 of the water passage 55, the water passage 62, and the third portion 583 of the radiator water passage 58. Then, the cooling water is suctioned into the pump 70 via the pump suctioning opening 70in.

On the other hand, the remaining of the cooling water flowing into the head water passage 51, flows into the radiator water passage 58 through the water passage 56. A part of the cooling water flowing into the radiator water passage 58, flows into the radiator 71 through the radiator water passage 58. Then, the cooling water flows through the radiator 71 and the radiator water passage 58 and then, is suctioned into the pump 70 via the pump suctioning opening 70in.

On the other hand, the remaining of the cooling water flowing into the radiator water passage 58, flows into the thermal device water passage 60 through the first portion 581 of the radiator water passage 58. The cooling water flowing into the thermal device water passage 60, flows through the thermal device 72, the thermal device water passage 60, the second portion 582 of the radiator water passage 58, and the third portion 583 of the radiator water passage 58. Then, the cooling water is suctioned into the pump 70 via the pump suctioning opening 70in.

Thereby, the same effects as the effects achieved by the activation control C are achieved, and the EGR cooler water supply and/or the heater core water supply are/is accomplished in response to the EGR cooler water supply request and/or the heater core water supply request.

Similar to the embodiment apparatus executing the activation control C, when the embodiment apparatus executes the activation control D while the water temperature difference ΔTW is large, the embodiment apparatus decreases the opening degree of the switching valve 78 set to the opposite flow position, compared with when the water temperature difference ΔTW is small. In particular, the embodiment apparatus executes the activation control D such that the opening degree of the switching valve 78 decreases as the water temperature difference ΔTW increases.

<Completely-Warmed State Control>

Next, a completely-warmed state control corresponding to the activation control of the pump 70 and the like will be described. The completely-warmed state control is executed when the embodiment apparatus determines that the warmed state is the completely-warmed state.

When the warmed state is the completely-warmed state, the cylinder head 14 and the cylinder block 15 should be cooled. Accordingly, the embodiment apparatus cools the cylinder head 14 and the cylinder block 15 by the cooling water cooled by the radiator 71 when the warmed state is the completely-warmed state.

<Activation Control E>

In particular, when the EGR cooler water supply and the heater core water supply are not requested while the warmed state is the completely-warmed state, the embodiment apparatus executes the activation control E. According to the activation control E, the embodiment apparatus activates the pump 70, sets the shut-off valve 77 to the closed position, sets the shut-off valve 75 to the open position, and sets the switching valve 78 to the normal flow position. When the embodiment apparatus executes the activation control E, the cooling water circulates as shown by arrows in FIG. 9. When the embodiment apparatus executes the activation control L, the embodiment apparatus sets the pump discharging flow rate to the flow rate capable of cooling the cylinder head 14 and the cylinder block 15 sufficiently.

According to the activation control E, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57. The cooling water flowing into the radiator water passage 58, flows through the radiator 71 and then, is suctioned into the pump 70 via the pump suctioning opening 70in.

Thereby, the cooling water is supplied to the head and block water passages 51 and 52 through the radiator 71. Thus, the cylinder head 14 and the cylinder block 15 are cooled by the cooling water having the low temperature.

<Activation Control F>

When any of the EGR cooler water supply and the heater core water supply is requested while the warmed state is the completely-warmed state, the embodiment apparatus executes the activation control F. According to the activation control F, the embodiment apparatus activates the pump 70, sets the shut-off valves 75 and 77 to the open positions, respectively, and sets the switching valve 78 to the normal flow position. When the embodiment apparatus executes the activation control F, the cooling water circulates as shown by arrows in FIG. 10. When the embodiment apparatus executes the activation control F, the embodiment apparatus sets the pump discharging flow rate to the flow rate capable of cooling the cylinder head 14 and the cylinder block 15 sufficiently.

According to the activation control F, a part of the cooling water discharged to the water passage 53 via the pump discharging opening 70out, flows into the head water passage 51 via the water passage 54. The remaining of the cooling water discharged to the water passage 53 via the pump discharging opening 70out, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70in.

The remaining of the cooling water flowing into the radiator water passage 58, flows into the thermal device water passage 60. The cooling water flowing into the thermal device water passage 60, flows through the thermal device 72 and then, flows through the water passage 60, the second portion 582 of the radiator water passage 58, and the third portion 583 of the radiator water passage 58. Then, the cooling water is suctioned into the pump 70 via the pump suctioning opening 70in.

Thereby, the same effects as the effects achieved by the activation control E are achieved, and the EGR cooler water supply and/or the heater core water supply are/is accomplished in response to the EGR cooler water supply request and/or the heater core water supply request.

As described above, the embodiment apparatus supplies the cooling water to the head and block water passages 51 and 52 when the embodiment apparatus executes any of the activation controls A to F. Therefore, the temperature of the cooling water represents the temperatures of the cylinder head 14 and the cylinder block 15. Thus, for example, the cylinder block 15 is likely to be warmed completely when the activation control is changed from the activation control C to the activation control E on the basis of the temperature of the cooling water. In addition, the temperature of the cooling water is prevented from increasing excessively in the block water passage 52 while the activation control C is executed.

<Concrete Operation of Embodiment Apparatus>

Next, a concrete operation of the embodiment apparatus will be described. The CPU of the ECU 90 of the embodiment apparatus is configured or programmed to execute a routine shown by a flowchart in FIG. 11 each time a predetermined time elapses.

Figure 11:
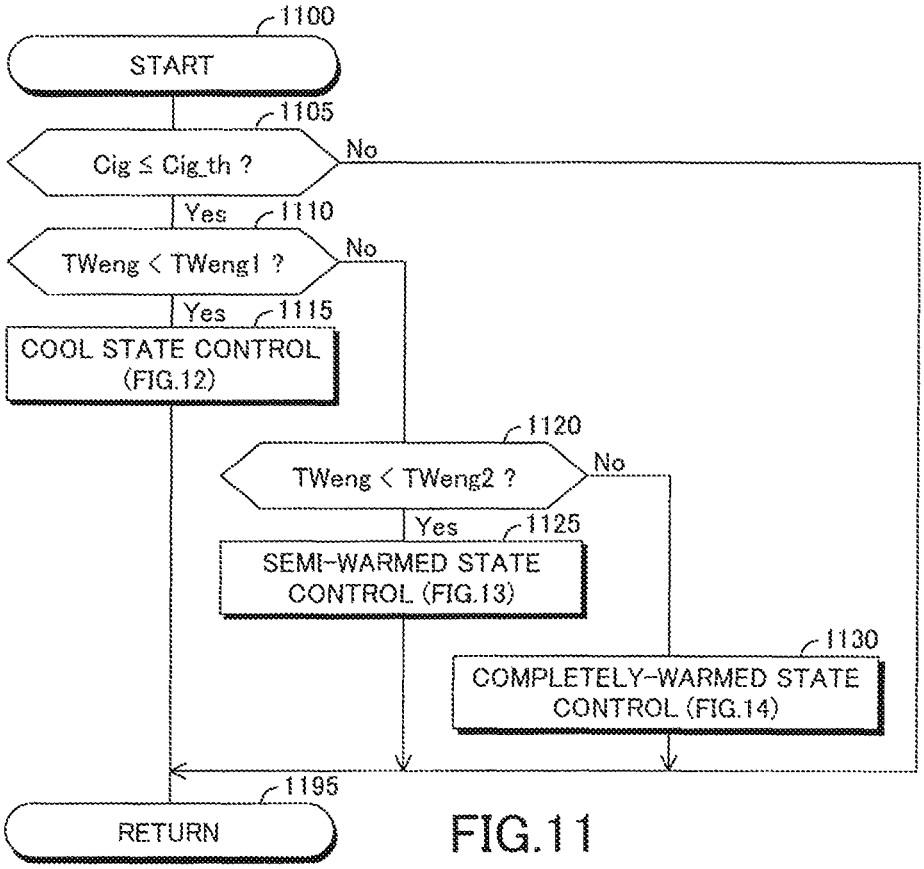
FIG. 11 is a flowchart for showing a routine executed by a CPU of an ECU shown in FIG. 1 and FIG. 2.

Therefore, at a predetermined timing, the CPU starts a process from a step 1100 of FIG. 11 and then, proceeds with the process to a step 1105 to determine whether the after-engine-start cycle number Cig is equal to or smaller than the predetermined after-engine-start cycle number Cig_th. When the after-engine-start cycle number Cig is larger than the predetermined after-engine-start cycle number Cig_th, the CPU determines "No" at the step 1105 and then, proceeds with the process to a step 1195 to terminate this routine once.

On the other hand, when the after-engine-start cycle number Cig is equal to or smaller than the predetermined after-engine-start cycle number Cig_th, the CPU determines "Yes" at the step 1105 and then, proceeds with the process to a step 1110 to determine whether the engine water temperature TWeng is lower than the first engine water temperature TWeng1.

Figure 12:
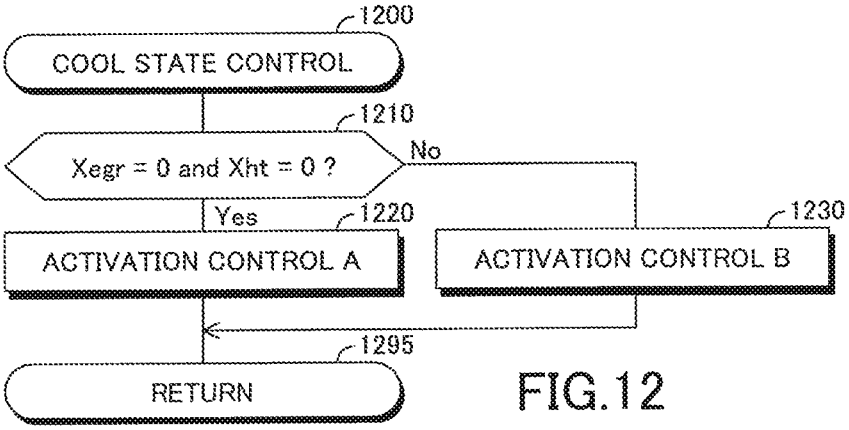
FIG. 12 is a flowchart for showing a routine executed by the CPU.

When the engine water temperature TWeng is lower than the first engine water temperature TWeng1, the CPU determines "Yes" at the step 1110 and then, proceeds with the process to the step 1115 to execute a cool state control routine shown by a flowchart in FIG. 12.

Therefore, when the CPU proceeds with the process to the step 1115, the CPU starts a process from a step 1200 of FIG. 12 and then, proceeds with the process to a step 1210 to determine whether a value of an EGR cooler water supply request flag Xegr is "0", and a value of a heater core water supply request flag Xht is "0", that is, the EGR cooler water supply and the heater core water supply are not requested. The value of the flag Xegr is set by a routine shown in FIG. 16 described later, and the value of the flag Xht is set by a routine shown in FIG. 17 described later.

Figure 5:
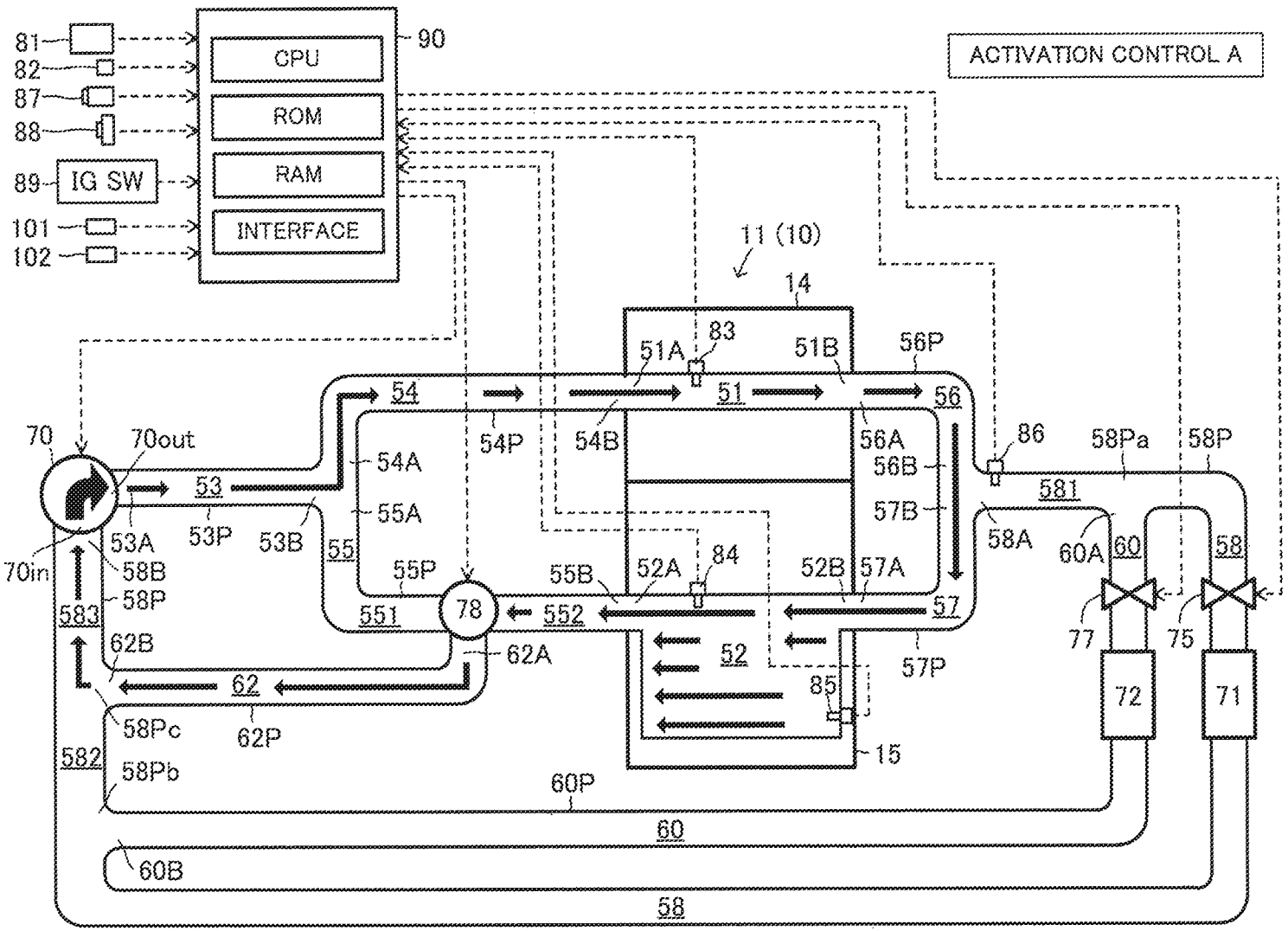
FIG. 5 is a view similar to FIG. 2 and which shows flow of cooling water when the cooling apparatus according to the embodiment executes an activation control A.

When the values of the EGR cooler water supply request flag Xegr and the heater core water supply request flag Xht are "0", respectively, the CPU determines "Yes" at the step 1210 and then, proceeds with the process to a step 1220 to execute the activation control A to control the activation of the pump 70 and the like (see FIG. 5). Then, the CPU proceeds with the process to the step 1195 of FIG. 11 via a step 1295 to terminate this routine once.

Figure 6:
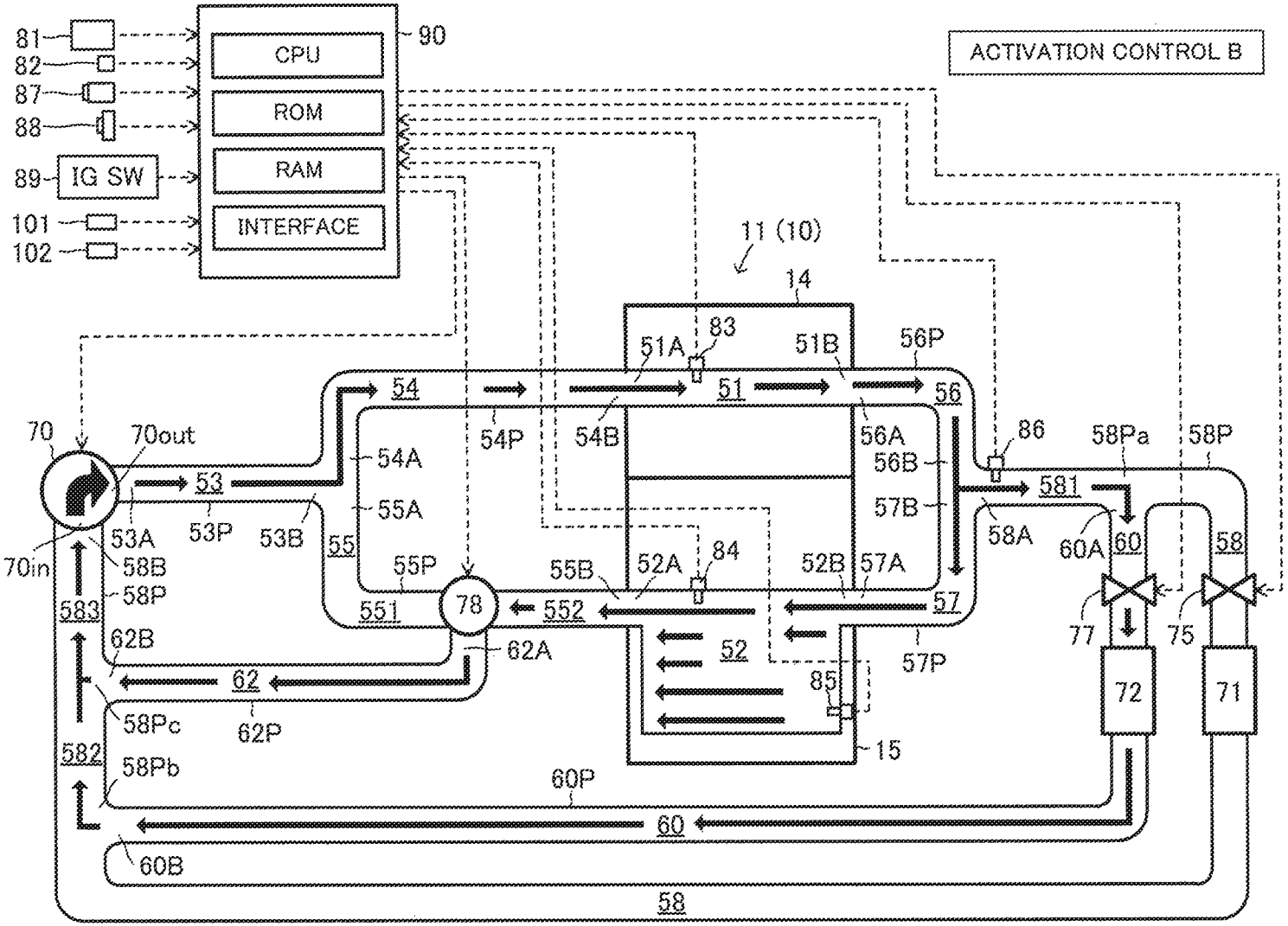
FIG. 6 is a view similar to FIG. 2 and which shows flow of cooling water when the cooling apparatus according to the embodiment executes an activation control B.

On the other hand, when any of the values of the EGR cooler water supply request flag Xegr and the heater core water supply request flag Xht is "1" at a time of the CPU executing the process of the step 1210, the CPU determines "No" at the step 1210 and then, proceeds with the process to a step 1230 to execute the activation control B to control the activation of the pump 70 and the like (see FIG. 6). Then, the CPU proceeds with the process to the step 1195 of FIG. 11 via the step 1295 to terminate this routine once.

When the engine temperature TWeng is equal to or higher than the first engine water temperature TWeng1 at a time of the CPU executing the process of the step 1110 of FIG. 11, the CPU determines "No" at the step 1110 and then, proceeds with the process to a step 1120 to determine whether the engine water temperature TWeng is lower than the second engine water temperature TWeng2.

Figure 13:
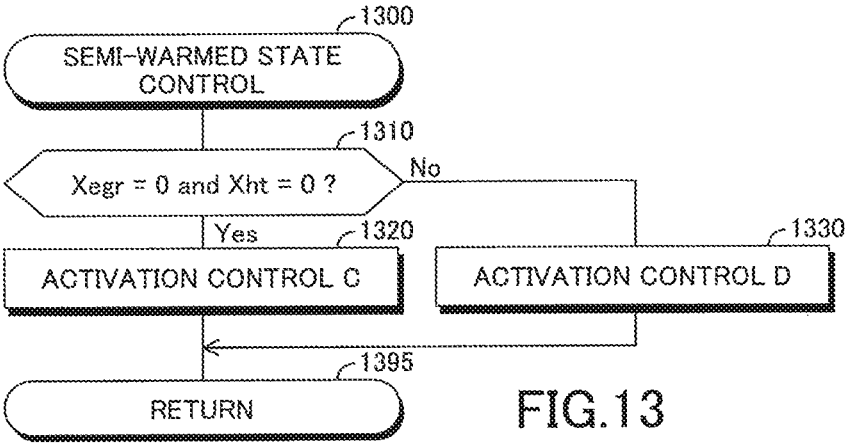
FIG. 13 is a flowchart for showing a routine executed by the CPU.

When the engine water temperature TWeng is lower than the second engine water temperature TWeng2, the CPU determines "Yes" at the step 1120 and then, proceeds with the process to a step 1125 to execute a semi-warmed state control routine shown by a flowchart in FIG. 13.

Therefore, when the CPU proceeds with the process to the step 1125, the CPU starts a process from a step 1300 of FIG. 13 and then, proceeds with the process to a step 1310 to determine whether the values of the EGR cooler water supply request flag Xegr and the heater core water supply request flag Xht are "0", that is, the EGR cooler water supply and the heater core water supply are not requested.

Figure 7:
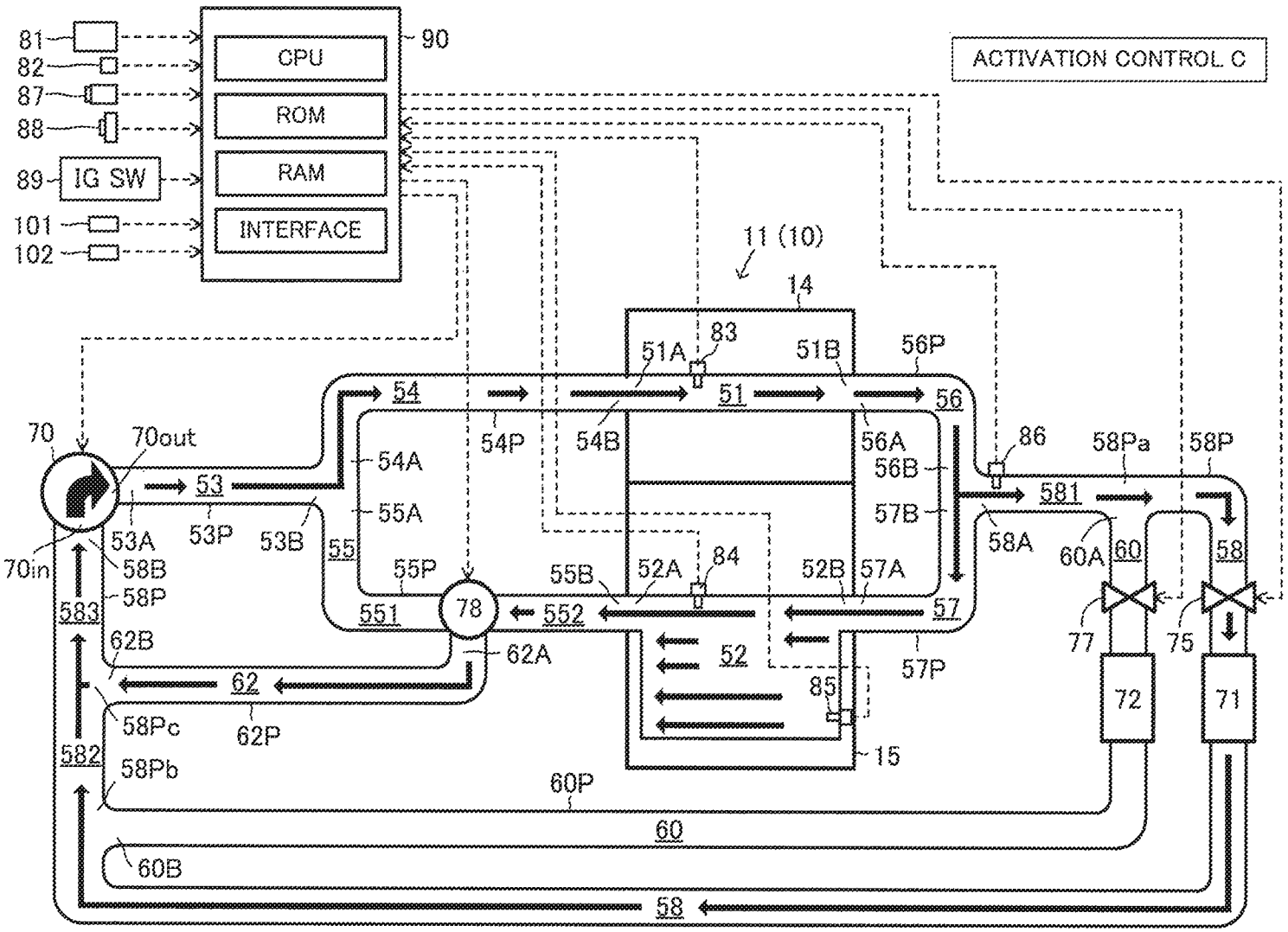
FIG. 7 is a view similar to FIG. 2 and which shows flow of cooling water when the cooling apparatus according to the embodiment executes an activation control C.

When the values of the EGR water supply request flag Xegr and the heater core water supply request flag Xht are "0", respectively, the CPU determines "Yes" at the step 1310 and then, proceeds with the process to a step 1320 to execute the activation control C to control the activation of the pump 70 and the like (see FIG. 7). Then, the CPU proceeds with the process to the step 1195 of FIG. 11 via a step 1395 to terminate this routine once.

Figure 8:
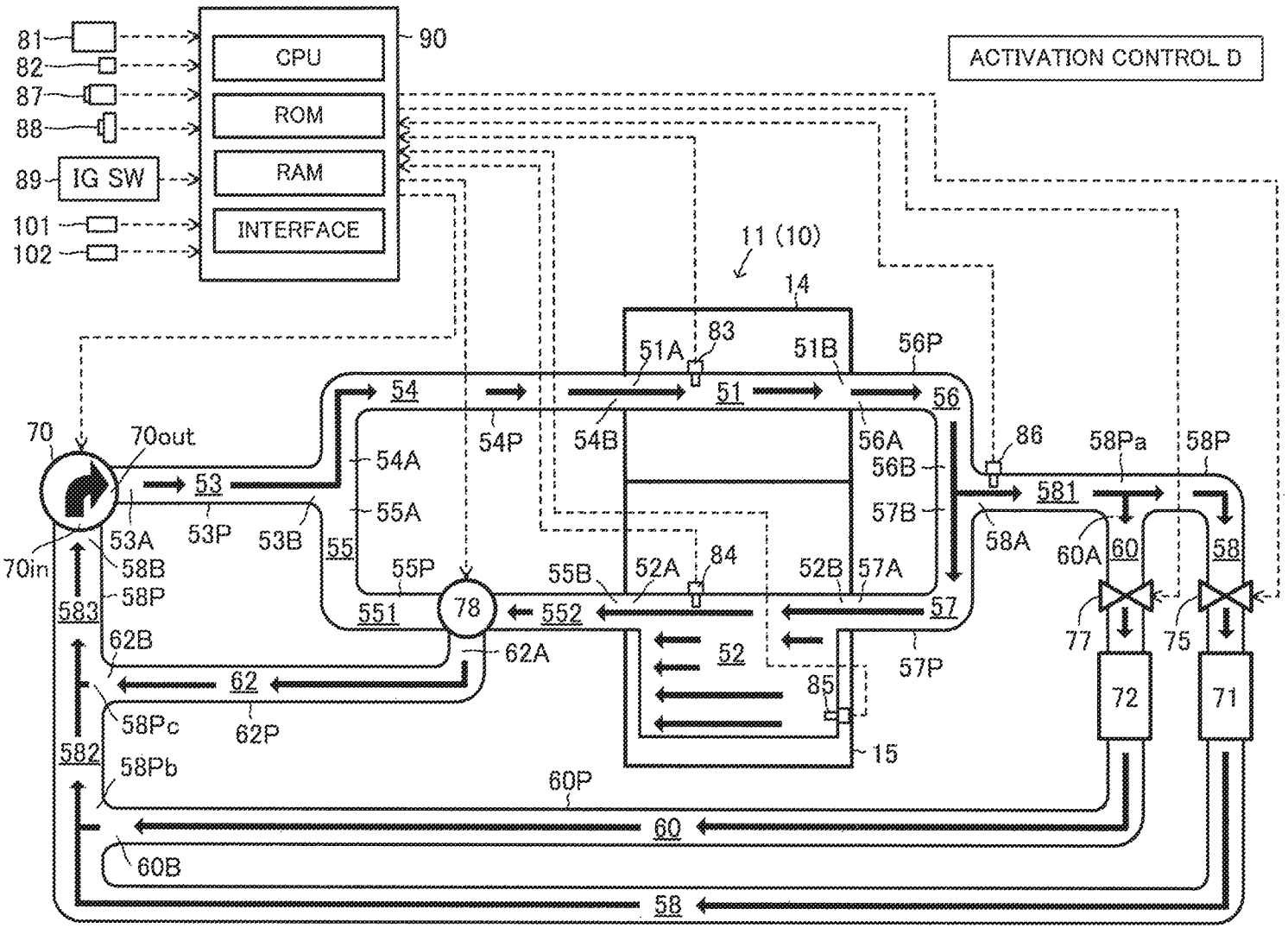
FIG. 8 is a view similar to FIG. 2 and which shows flow of cooling water when the cooling apparatus according to the embodiment executes an activation control D.

On the other hand, when any of the values of the EGR cooler water supply request flag Xegr and the heater core water supply request flag Xht is "0" at a time of the CPU executing the process of the step 1310, the CPU determines "No" at the step 1310 and then, proceeds with the process to a step 1330 to execute the activation control D to control the activation of the pump 70 and the like (see FIG. 8). Then, the CPU proceeds with the process to the step 1195 of FIG. 11 via the step 1395 to terminate this routine once.

When the engine water temperature TWeng is equal to or higher than the second engine water temperature TWeng2 at a time of the CPU executing the process of the step 1120 of FIG. 11, the CPU determines "No" at the step 1120 and then, proceeds with the process to a step 1130 to execute a completely-warmed state control routine shown by a flowchart in FIG. 24.

Figure 14:
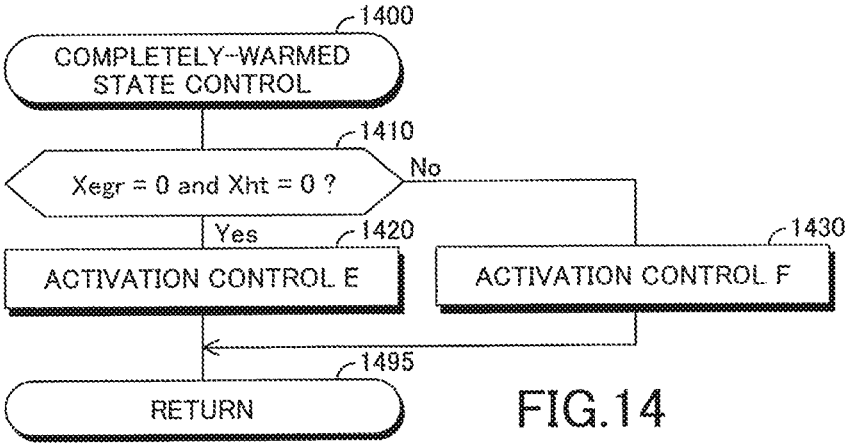
FIG. 14 is a flowchart for showing a routine executed by the CPU.

Therefore, when the CPU proceeds with the process to the step 1130, the CPU starts a process from a step 1400 of FIG. 14 and then, proceeds with the process to a step 1410 to determine whether the values of the EGR cooler water supply request flag Xegr and the Xht are "0", respectively, that is, the EGR cooler water supply and the heater core water supply are not requested.

Figure 9:
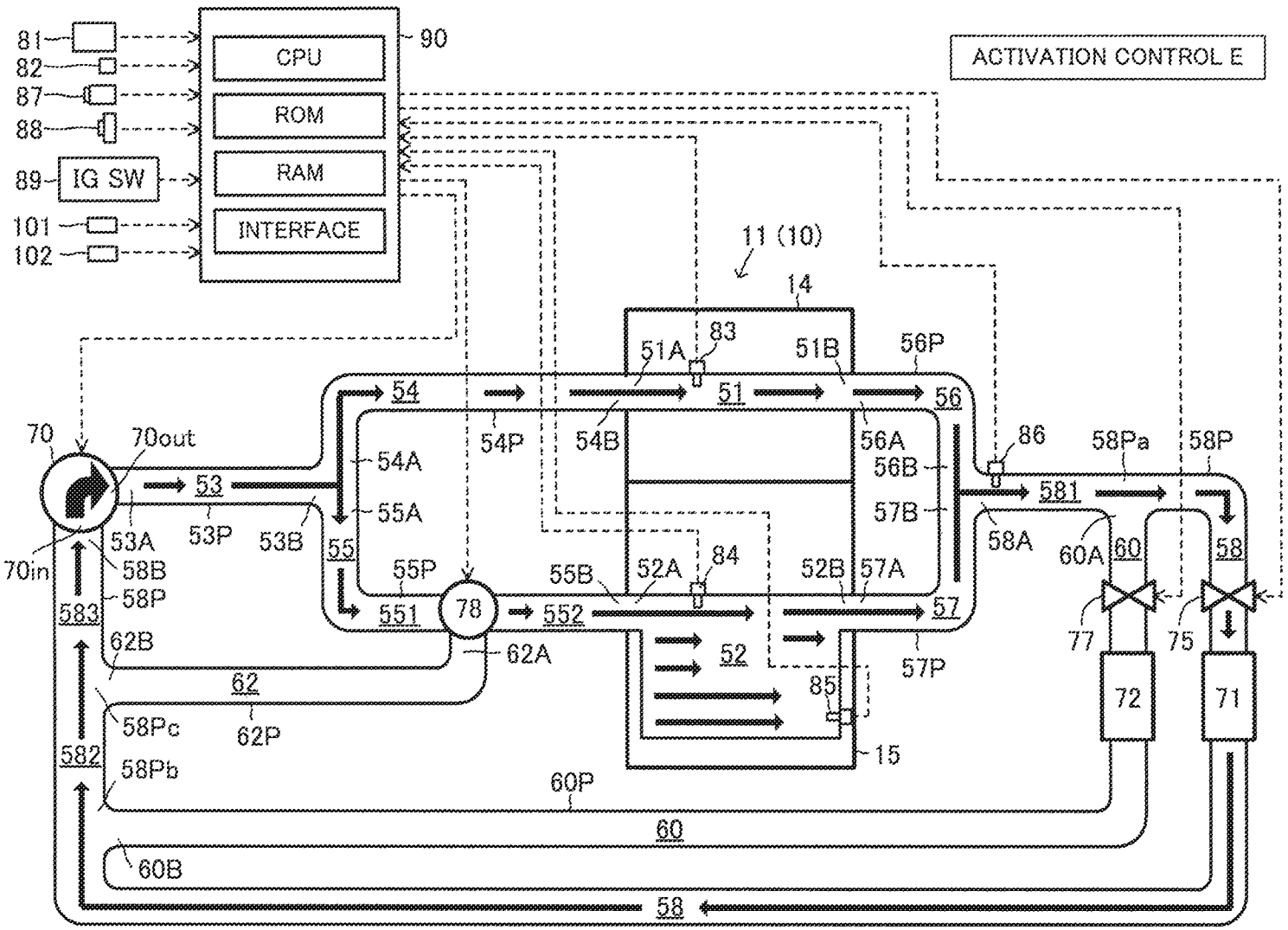
FIG. 9 is a view similar to FIG. 2 and which shows flow of cooling water when the cooling apparatus according to the embodiment executes an activation control E.

When the values of the EGR cooler water supply request flag Xegr and the heater core water supply request flag Xht are "1", respectively, the CPU determines "Yes" at the step 1410 and then, proceeds with the process to a step 1420 to execute the activation control E to control the activation of the pump 70 and the like (see FIG. 9). Then, the CPU proceeds with the process to the step 1195 of FIG. 11 via a step 1495 to terminate this routine once.

Figure 10:
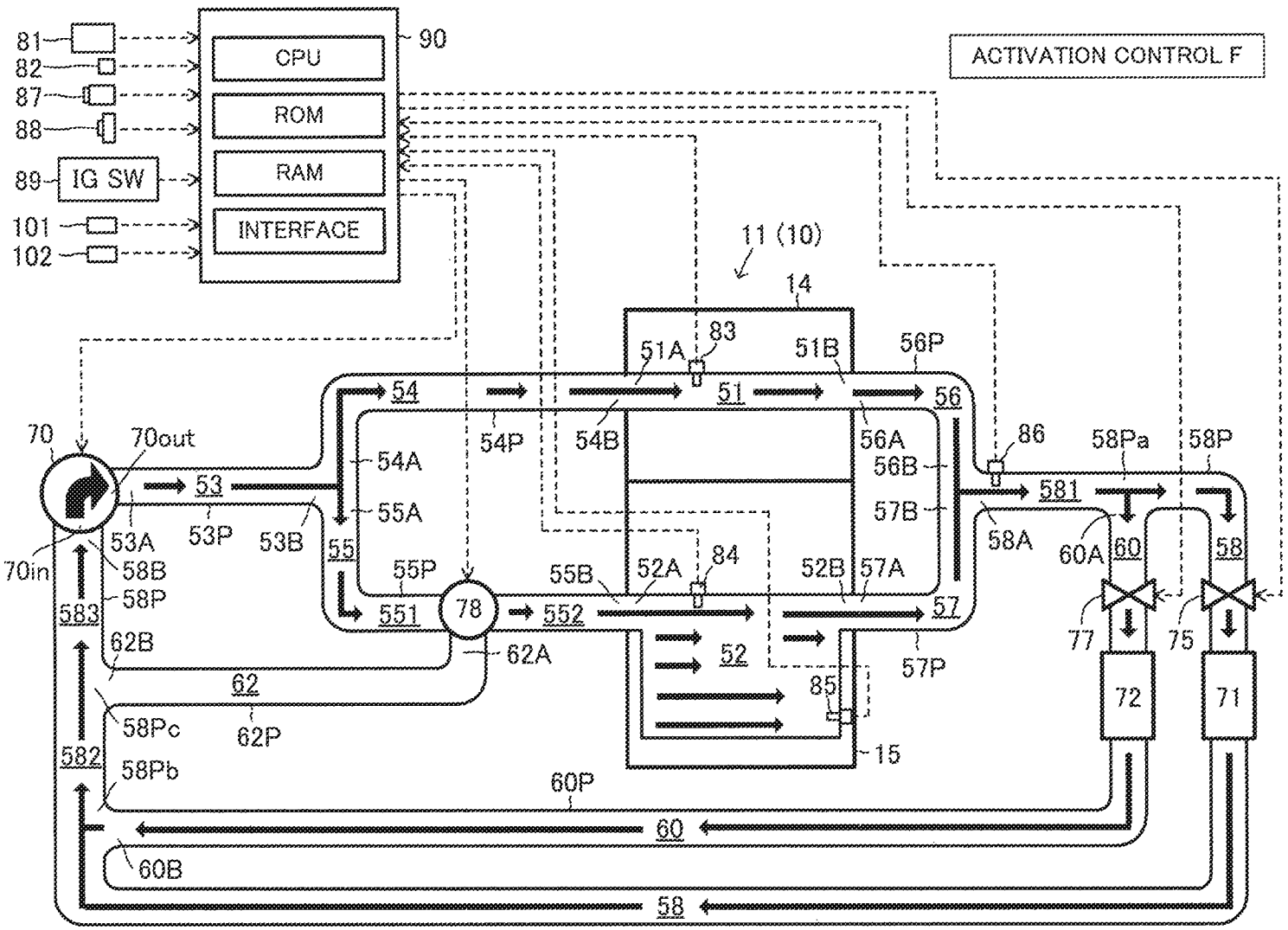
FIG. 10 is a view similar to FIG. 2 and which shows flow of cooling water when the cooling apparatus according to the embodiment executes an activation control F.

On the other hand, when any of the values of the EGR cooler water supply request flag Xegr and the heater core water supply request flag Xht is "1" at a time of the CPU executing the process of the step 1410 of FIG. 14, the CPU determines "No" at the step 1410 and then, proceeds with the process to a step 1430 to execute the activation control F to control the activation of the pump 70 and the like (see FIG. 10). Then, the CPU proceeds with the process to the step 1195 of FIG. 11 via the step 1495 to terminate this routine once.

Figure 15:
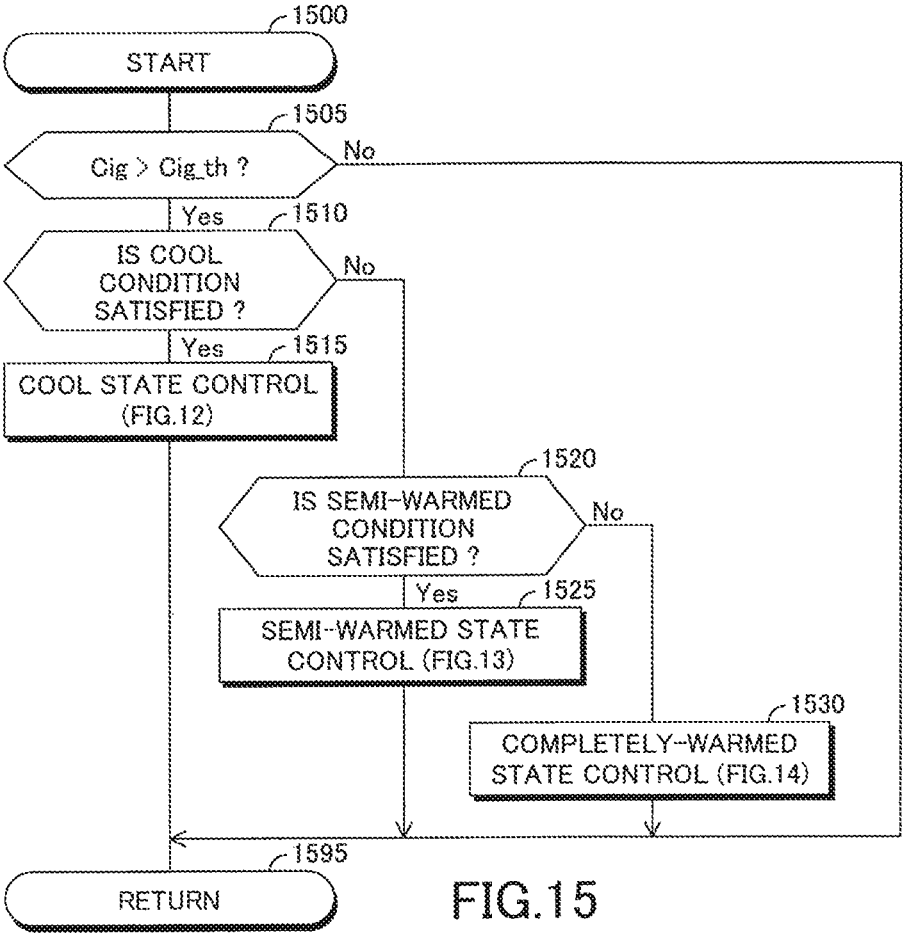
FIG. 15 is a flowchart for showing a routine executed by the CPU.

Further, the CPU is configured or programmed to execute a routine shown by a flowchart in FIG. 15 each time a predetermined time elapses. Therefore, at a predetermined timing, the CPU starts a process from a step 1500 of FIG. 15 and then, proceeds with the process to a step 1505 to determine whether the after-engine-start cycle number Cig is larger than the predetermined after-engine-start cycle number Cig_th.

When the after-engine-start cycle number Cig is equal to or smaller than the predetermined after-engine-start cycle number Cig_th, the CPU determines "No" at the step 1505 and then, proceeds with the process to a step 1595 to terminate this routine once.

On the other hand, when the after-engine-start cycle number Cig is larger than the predetermined after-engine-start cycle number Cig_th, the CPU determines "Yes" at the step 1505 and then, proceeds with the process to a step 1510 to determine whether the cool condition is satisfied. When the cool condition is satisfied, the CPU determines "Yes" at the step 1510 and then, proceeds with the process to a step 1515 to execute the aforementioned cool state control routine shown in FIG. 12. Then, the CPU proceeds with the process to the step 1595 to terminate this routine once.

On the other hand, when the cool condition is not satisfied at a time of the CPU executing the process of the step 1510, the CPU determines "No" at the step 1510 and then, proceeds with the process to a step 1520 to determine whether the semi-warmed condition is satisfied. When the semi-warmed condition is satisfied, the CPU determines "Yes" at the step 1520 and then, proceeds with the process to a step 1525 to execute the aforementioned semi-warmed state control routine shown in FIG. 13. Then, the CPU proceeds with the process to the step 1595 to terminate this routine once.

When the semi-warmed condition is not satisfied at a time of the CPU executing the process of the step 1520, the CPU determines "No" at the step 1520 and then, proceeds with the process to a step 1530 to execute the aforementioned completely-warmed state control routine shown in FIG. 14. Then, the CPU proceeds with the process to the step 1595 to terminate this routine once.

Figure 16:
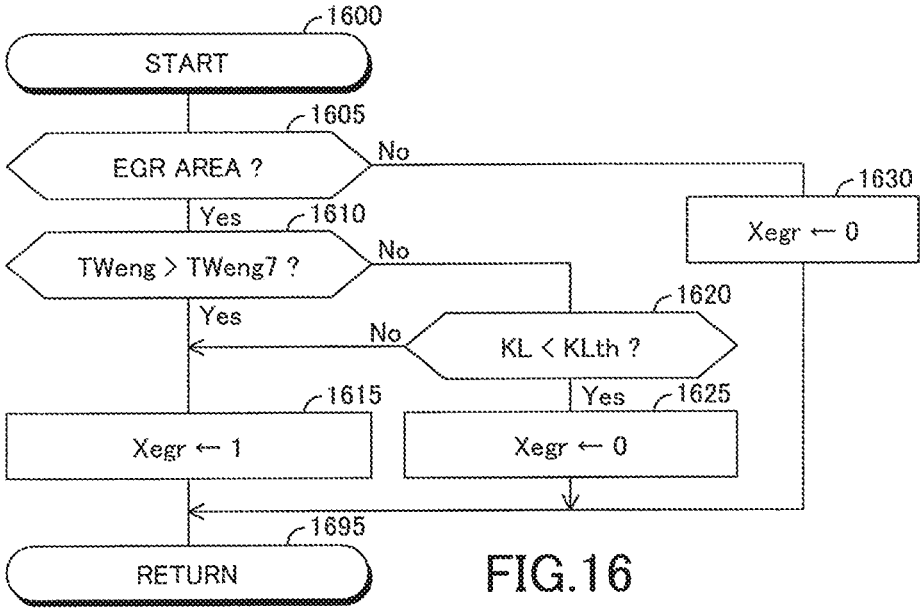
FIG. 16 is a flowchart for showing a routine executed by the CPU.

Further, the CPU is configured or programmed to execute a routine shown by a flowchart in FIG. 16 each time a predetermined time elapses. Therefore, at a predetermined timing, the CPU starts a process from a step 1600 of FIG. 16 and then, proceeds with the process to a step 1605 to determine whether the engine operation state is in the EGR area Rb.

When the engine operation state is in the EGR area Rb, the CPU determines "Yes" at the step 1605 and then, proceeds with the process to a step 1610 to determine whether the engine water temperature TWeng is higher than the seventh engine water temperature TWeng7.

When the engine water temperature TWeng is higher than the seventh engine water temperature TWeng7, the CPU determines "Yes" at the step 1610 and then, proceeds with the process to a step 1615 to set the value of the EGR cooler water supply request flag Xegr to "1." Then, the CPU proceeds with the process to a step 1695 to terminate this routine once.

On the other hand, when the engine water temperature TWeng is equal to or lower than the seventh engine water temperature TWeng7, the CPU determines "No" at the step 1610 and then, proceeds with the process to a step 1620 to determine whether the engine load KL is smaller than the threshold engine load KLth.

When the engine load KL is smaller than the threshold engine load KLth, the CPU determines "Yes" at the step 1620 and then, proceeds with the process to a step 1625 to set the value of the EGR cooler water supply request flag Xegr to "0." Then, the CPU proceeds with the process to the step 1695 to terminate this routine once.

On the other hand, when the engine load KL is equal to or larger than the threshold engine load KLth, the CPU determines "No" at the step 1620 and then, proceeds with the process to the step 1615 to set the value of the EGR cooler water supply request flag Xegr to "1." Then, the CPU proceeds with the process to the step 1695 to terminate this routine once.

When the engine operation state is not in the EGR area Rb at a time of the CPU executing a process of the step 1605, the CPU determines "No" at the step 1605 and then, proceeds with the process to a step 1630 to set the value of the EGR cooler water supply request flag Xegr to "0." Then, the CPU proceeds with the process to the step 1695 to terminate this routine once.

Figure 17:
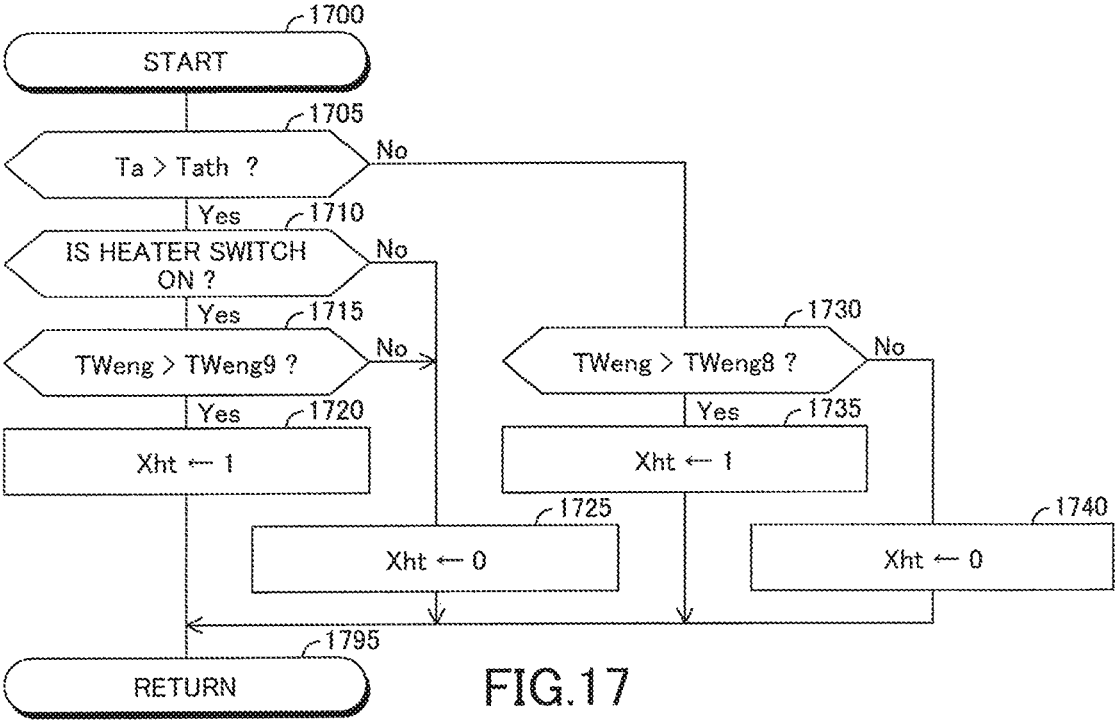
FIG. 17 is a flowchart for showing a routine executed by the CPU.

Further, the CPU is configured or programmed to execute a routine shown by a flowchart in FIG. 17 each time a predetermined time elapses. Therefore, at a predetermined timing, the CPU starts a process from a step 1700 of FIG. 17 and then, proceeds with the process to a step 1705 to determine whether the outside air temperature Ta is higher than the threshold temperature Tath.

When the outside air temperature Ta is higher than the threshold temperature Tath, the CPU determines "Yes" at the step 1705 and then, proceeds with the process to a step 1710 to determine whether the heater switch 88 is set to the ON position.

When the heater switch 88 is set to the ON position, the CPU determines "Yes" at the step 1710 and then, proceeds with the process to a step 1715 to determine whether the engine water temperature TWeng is higher than the ninth engine water temperature TWeng9.

When the engine water temperature TWeng is higher than the ninth engine water temperature TWeng9, the CPU determines "Yes" at the step 1715 and then, proceeds with the process to a step 1720 to set the value of the heater core water supply request flag Xht to "1." Then, the CPU proceeds with the process to a step 1795 to terminate this routine once.

On the other hand, when the engine water temperature TWeng is equal to or lower than the ninth engine water temperature TWeng9, the CPU determines "No" at the step 1715 and then, proceeds with the process to a step 1725 to set the value of the heater core water supply request flag Xht to "0." Then, the CPU proceeds with the process to the step 1795 to terminate this routine once.

When the heater switch 88 is set to the OFF position at a time of the CPU executing a process of the step 1710, the CPU determines "No" at the step 1710 and then, proceeds with the process to the step 1725 to set the value of the heater core water supply request flag Xht to "0." Then, the CPU proceeds with the process to the step 1795 to terminate this routine once.

When the outside air temperature Ta is equal to or lower than the threshold temperature Tath at a time of the CPU executing a process of the step 1705, the CPU determines "No" at the step 1705 and then, proceeds with the process to a step 1730 to determine whether the engine water temperature TWeng is higher than the eighth engine water temperature TWeng8.

When the engine water temperature TWeng is higher than the eighth engine water temperature TWeng8, the CPU determines "Yes" at the step 1730 and then, proceeds with the process to a step 1735 to set the value of the heater core water supply request flag Xht to "1." Then, the CPU proceeds with the process to the step 1795 to terminate this routine once.

On the other hand, when the engine water temperature TWeng is equal to or lower than the eighth engine water temperature TWeng8, the CPU determines "No" at the step 1730 and then, proceeds with the process to a step 1740 to set the value of the heater core water supply request flag Xht to "0." Then, the CPU proceeds with the process to the step 1795 to terminate this routine once.

The concrete operation of the embodiment apparatus has been described. Thereby, the cooling water flows through the head and block water passages 51 and 52 when any of the activation controls A to F is executed. Thus, the temperature of the cooling water represents the temperatures of the cylinder head 14 and the cylinder block 15. Therefore, the warmed state of the cylinder block 15 is determined accurately. Thus, the activation control E or F is unlikely to be executed before the cylinder block 15 is warmed completely. In addition, the activation control E or F is likely to be executed when the cylinder block 15 is warmed completely.

It should be noted that the present invention is not limited to the aforementioned embodiment and various modifications can be employed within the scope of the present invention.

For example, in the activation control A, all the cooling water flowing out from the head water passage 51, is supplied directly to the block water passage 52. In this regard, the embodiment apparatus may be configured to execute the activation control A such that a part of the cooling water flowing out from the head water passage 51, is supplied to the head water passage 51 through the radiator 71. In this case, the flow rate of the cooling water flowing through the radiator 71 in the activation control A, is controlled to the flow rate smaller than the flow rate of the cooling water flowing through the radiator 71 in the activation control C.

Similarly, the embodiment apparatus may be configured to execute the activation control B such that a part of the cooling water flowing out from the head water passage 51, is supplied to the head water passage 51 through the radiator 71. In this case, the flow rate of the cooling water flowing through the radiator 71 in the activation control B, is controlled to the flow rate smaller than the flow rate of the cooling water flowing through the radiator 71 in the activation control D.

Further, the embodiment apparatus may be configured to use an after-engine-start integration fuel amount ΣQ in place of or in addition to the after-engine-start integration air amount ΣGa. The after-engine-start integration fuel amount ΣQ is a total amount of the fuel supplied from the fuel injectors 13 to the cylinders 12*a* to 12*d* since the ignition switch 89 is set to the ON position.

The embodiment apparatus configured as such, determine that the warmed state is the cool state when the after-engine-start integration fuel amount ΣQ is equal to or smaller than a first threshold fuel amount ΣQ1. When the after-engine-start integration fuel amount ΣQ is larger than the first threshold fuel amount ΣQ1 and equal to or smaller than a second threshold fuel amount ΣQ2, the embodiment apparatus and the modified apparatuses determine that the warmed state is the semi-warmed state. Further, the embodiment apparatus and the modified apparatuses determine that the warmed state is the semi-warmed state when the after-engine-start integration fuel amount ΣQ is larger than the second threshold fuel amount ΣQ2 and equal to or smaller than a third threshold fuel amount ΣQ3. embodiment apparatus and the modified apparatuses determine that the warmed state is the completely-warmed state when the after-engine-start integration fuel amount ΣQ is larger than the third threshold fuel amount ΣQ3.

Further, the embodiment apparatus may be configured to determine that the EGR cooler water supply is requested when the engine water temperature TWeng is equal to or higher than the seventh engine water temperature TWeng7, and the engine operation state is in the EGR stop area Ra or Rc shown in FIG. 3. In this case, the processes of the steps 1605 and 1630 of FIG. 16 are omitted. Thereby, the cooling water is already supplied to the thermal device water passage 60 when the engine operation state changes from the EGR stop area Ra or Rc to the EGR area Rb. Thus, the EGR gas is cooled at the same time as the start of the supply of the EGR gas to the cylinders 12.

Further, the embodiment apparatus may be configured to determine that the heater core water supply is requested, independently of the set state of the heater switch 88 when the outside air temperature Ta is higher than the threshold temperature Tath, and the engine water temperature TWeng is higher than the ninth engine water temperature TWeng9. In this case, the process of the step 1710 of FIG. 17 is omitted.

Further, the invention can be applied to a cooling apparatus which does not include the water passage 60 and the shut-off valve 77.

Further, the water temperature sensor 83 may be provided in the cooling water pipe 58P for detecting the temperature of the cooling water flowing through the water passage 56. The water temperature sensor 84 may be provided in the cooling water pipe 55P for detecting the temperature of the cooling water flowing through the second portion 552 of the water passage 55.

Figure 18A:
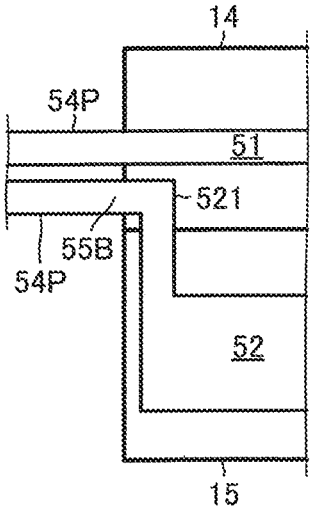
FIG. 18A is a view for showing a part of cooling water circulation routes which the cooling apparatus according to the embodiment may employ.

Furthermore, the embodiment apparatus may be configured as shown in FIG. 18A. In the configuration shown in FIG. 18A, the second end 55B of the cooling water pipe 55P is connected to the block water passage 52 by a block connection water passage 521 formed in the cylinder head 14.

Figure 18B:
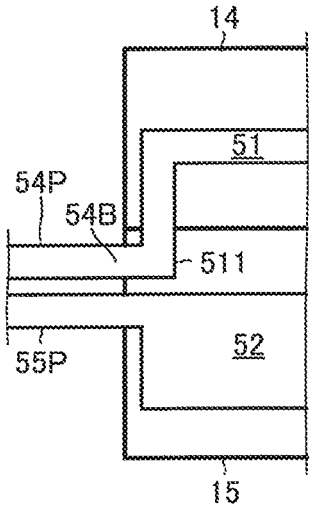
FIG. 18B is a view for showing a part of another cooling water circulation routes which the cooling apparatus according to the embodiment may employ.

Further, the embodiment apparatus may be configured as shown in FIG. 18B. In the configuration shown in FIG. 18B, the second end 54B of the cooling water pipe 54P is connected to the head water passage 51 by a head connection water passage 511 formed in the cylinder block 15.

Figure 19A:
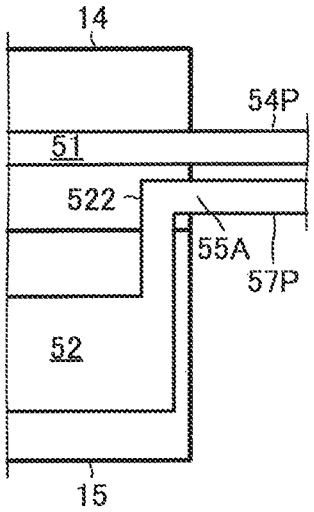
FIG. 19A is a view for showing a part of further another cooling water circulation routes which the cooling apparatus according to the embodiment may employ.

Furthermore, the embodiment apparatus may be configured as shown in FIG. 19A. In the configuration shown in FIG. 19A, the block water passage 52 is connected to the first end 57A of the cooling water pipe 57P by a block connection water passage 522 formed in the cylinder head 14.

Figure 19B:
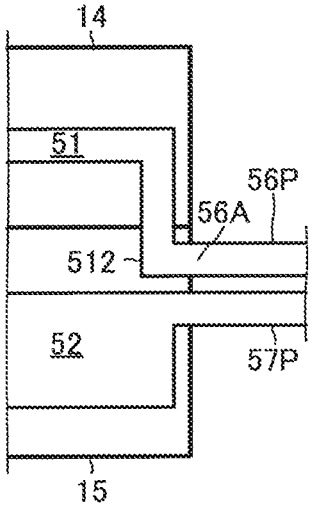
FIG. 19B is a view for showing a part of further another cooling water circulation routes which the cooling apparatus according to the embodiment may employ.

Further, the embodiment apparatus may be configured as shown in FIG. 19B. In the configuration shown in FIG. 19B, the head water passage 51 is connected to the first end 56A of the cooling water pipe 56P by a head connection water passage 512 formed in the cylinder block 15.

Figure 20A:
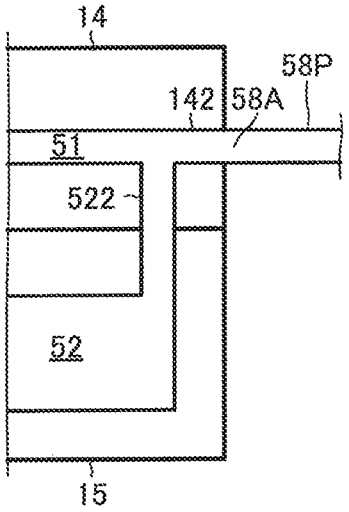
FIG. 20A is a view for showing a part of further another cooling water circulation routes which the cooling apparatus according to the embodiment may employ.

Furthermore, the embodiment apparatus may be configured as shown in FIG. 20A. In the configuration shown in FIG. 20A, a common connection water passage 142 and the block connection water passage 522 are formed in the cylinder head 14. The head water passage 51 is connected to the first end 58A of the cooling water pipe 58P by the common connection water passage 142. The block water passage 52 is connected to the first end 58A of the cooling water pipe 58P by the block connection water passage 522 and the common connection water passage 142.

Figure 20B:
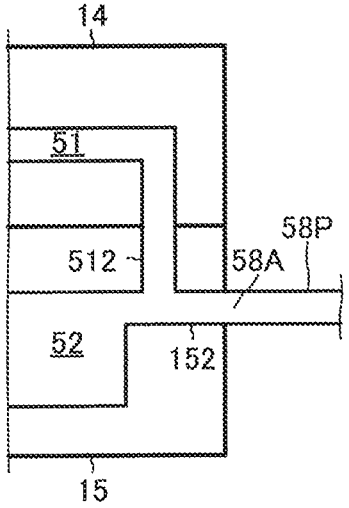
FIG. 20B is a view for showing a part of further another cooling water circulation routes which the cooling apparatus according to the embodiment may employ.

Further, the embodiment apparatus may be configured as shown in FIG. 20B. In the configuration shown in FIG. 20B, a common connection water passage 152 and the head connection water passage 512 are formed in the cylinder block 15. The head water passage 51 is connected to the first end 58A of the cooling water pipe 58P by the head connection water passage and the common connection water passage 152. The block water passage 52 is connected to the first end 58A of the cooling water pipe 58P by the common connection water passage 152.

What is claimed is:

1. A cooling apparatus of an internal combustion engine, comprising:

a head water passage provided in a cylinder head of the internal combustion engine, through which cooling water for cooling the cylinder head flows;

a block water passage provided in a cylinder block of the internal combustion engine, through which the cooling water for cooling the cylinder block flows;

a pump including a pump discharging opening in fluid communication with a first water passage leading to a first end of the head water passage and a second water passage leading to a first end of the block water passage, and a pump suctioning opening;

a switching valve provided in the second water passage leading to the first end of the block water passage in between a first portion of the second water passage extending from the pump discharging opening to the switching valve and a second portion of the second water passage extending from the switching valve to the first end of the block water passage, the switching valve being connected to a third water passage in fluid communication with the pump suctioning opening;

a radiator for cooling the cooling water; and an electronic control unit for controlling a flow of the cooling water supplied to the head and block water passages, wherein the electronic control unit is configured to:

execute an incompletely-warmed state control for supplying the cooling water directly to the block water passage from the head water passage without flowing the cooling water through the pump or the radiator on the way from the head water passage to the block water passage, wherein the incompletely-warmed state control includes selectively switching the switching valve to an opposite flow position wherein the switching valve permits flow of the cooling water from the second portion of the second water passage through the switching valve and into the third water passage in fluid communication with the pump suctioning opening, and supplying the cooling water to the head water passage from the block water passage when a temperature of the cooling water is lower than an engine completely-warmed water temperature at which the engine is estimated to be warmed completely; and execute a completely-warmed state control for supplying the cooling water to the head and block water passages from the head and block water passages through the radiator when the temperature of the cooling water is equal to or higher than the engine completely-warmed water temperature, wherein the completely-warmed state control includes selectively switching the switching valve to a normal flow position wherein the switching valve permits flow of the cooling water from the first portion of the second water passage through the switching valve to the second portion of the second water passage, through the block water passage, and through the radiator to the pump suctioning opening.

2. The cooling apparatus according to claim 1, wherein the electronic control unit is configured to:

execute a cool state control as the incompletely-warmed state control for supplying a first amount of the cooling water directly to the block water passage from the head water passage without flowing the cooling water through the pump or the radiator, supplying the remaining amount of the cooling water to the block water passage from the head water passage through the radiator, and supplying the cooling water to the head water passage from the block water passage when the temperature of the cooling water is lower than a semi-warmed water temperature lower than the engine completely warmed water temperature; and execute a semi-warmed state control as the incompletely-warmed state control for supplying a second amount of the cooling water to the head water passage from the head water passage through the radiator, supplying the remaining amount of the cooling water to the block water passage from the head water passage without flowing the cooling water through the radiator, and supplying the cooling water to the head water passage from the block water passage when the temperature of the cooling water is equal to or higher than the semi-warmed water temperature, the second amount being larger than the first amount.

3. The cooling apparatus according to claim 2, wherein the electronic control unit is configured to execute the semi-warmed state control to control a flow rate of the cooling water in the block water passage such that the flow rate of the cooling water in the block water passage is small when a difference in the temperature of the cooling water between after and before the cooling water flows through the block water passage, is small, compared with when the difference in the temperature of the cooling water is large.

* * * * *